US007595706B2

(12) United States Patent
Kato et al.

(10) Patent No.: US 7,595,706 B2
(45) Date of Patent: Sep. 29, 2009

(54) HIGH-FREQUENCY DISTRIBUTION CIRCUIT FOR DISTRIBUTING HIGH-FREQUENCY SIGNAL

(75) Inventors: Masahiro Kato, Nagaokakyo (JP); Takao Hirano, Nara (JP); Hitoshi Tanaka, Neyagawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 381 days.

(21) Appl. No.: 11/371,004

(22) Filed: Mar. 9, 2006

(65) Prior Publication Data

US 2006/0211367 A1 Sep. 21, 2006

(30) Foreign Application Priority Data

May 11, 2005 (JP) ..... 2005-138352
Jun. 21, 2005 (JP) ..... 2005-180657

(51) Int. Cl.
*H01P 1/10* (2006.01)

(52) U.S. Cl. ..... 333/101; 333/262; 200/181

(58) Field of Classification Search ..... 331/101, 331/103, 104, 262; 333/101, 103, 104, 262, 333/125, 127, 136, 138, 260
See application file for complete search history.

(56) References Cited

U.S. PATENT DOCUMENTS 4,802,239 A * 1/1989 Ooto ..... 455/150.1
5,274,343 A * 12/1993 Russell et al. ..... 333/103
6,844,793 B2 * 1/2005 Kenington ..... 333/101
2005/0110594 A1 * 5/2005 Culliton et al. ..... 333/125

FOREIGN PATENT DOCUMENTS

JP 01218205 A * 8/1999
JP 2002-218329 A 8/2002

* cited by examiner

*Primary Examiner*—Benny Lee
*Assistant Examiner*—Gerald Stevens
(74) *Attorney, Agent, or Firm*—Birch, Stewart, Kolasch & Birch, LLP

(57) ABSTRACT

The present high-frequency distribution circuit includes a switch circuit which passes a high-frequency signal from the other terminal of a high-frequency line to an output terminal if a receiver is connected to the output terminal and which grounds the other terminal of the high-frequency line via a terminator resistor if the receiver is not connected to the output terminal. As seen at an input terminal toward the output terminal, a constant value in resistance is provided regardless of whether the output terminal is used or not.

20 Claims, 19 Drawing Sheets

HIGH-FREQUENCY DISTRIBUTION CIRCUIT FOR DISTRIBUTING HIGH-FREQUENCY SIGNAL

This nonprovisional application is based on Japanese Patent Applications Nos. 2004-263990, 2005-039408, 2005-138352, and 2005-180657 filed with the Japan Patent Office on Sep. 10, 2004, Feb. 16, 2005, May 11, 2005, and Jun. 21, 2005, respectively, the entire contents of which are hereby incorporated by reference. Japanese Application 2005-180657 was published as Japanese Patent Laid-Open No. 2006-345464 on Dec. 21, 2006.

BACKGROUND OF THE INVENTION

1. Field of the Invention

The present invention relates generally to high-frequency distribution circuits and particularly to high-frequency distribution circuits distributing to a plurality of output terminals a frequency signal received at an input terminal.

2. Description of the Background Art

FIG. 19 is a block diagram showing a configuration of a receiving unit of a satellite broadcast system as conventional. In FIG. 19 the satellite broadcast system has the receiving unit including an antenna 103 having a reflector 101 and a low noise block down converter (LNB) 102, receivers (or load circuits) 104 and 105, and television sets 106 and 107.

A satellite emits an electric wave α which is received via reflector 101 by LNB 102. LNB 102 extracts video signals of a plurality of channels from the received electric wave α and also amplifies the video signals with minimized noise, and provides receivers 104 and 105 with video signals (or high-frequency signals) of the channels selected by receivers 104 and 105, respectively. LNB 102 outputs a signal which is in turn FM-demodulated in each of receivers 104 and 105 and furthermore converted to video and audio signals and provided to television sets 106 and 107. Television sets 106 and 107 display on their screens the video images of the channels selected by the tuners of receivers 104 and 105, respectively (see for example Japanese Patent Laying-Open No. 2002-218329).

Such LNB 102 is provided therein with a high-frequency distribution circuit distributing a video signal to the two receivers 104 and 105, and its power supply voltage is supplied from receivers 104 and 105.

The characteristic impedance of a coaxial cable connected to each output terminal of such LNB 102, switch (SW)-BOX and the like, and the input impedance of receivers 104 and 105 are typically 75Ω. As such, if in LNB 102 or the like a received signal is monitored at one output terminal and the other output terminal has nothing connected thereto, then at the other output terminal the received signal is totally reflected. Thus whether the other output terminal is connected or not provides a difference in level of a received signal monitored at one output terminal, poor isolation, and other similar disadvantages.

If any unused output terminal is terminated by a termination of 75Ω, the variation in impedance attributed to whether the output terminal is used or not can be eliminated. Providing the LNB, the SW-BOX or other similar products with a termination as an accessory, however, is significantly costly.

A final-stage amplifier or the like may have an attenuator inserted therein to attenuate in level a signal reflected from an output terminal. This, however, requires that the amplifier be increased in gain, which can result in increased current consumption, poor phase noise, and/or similar detriments.

SUMMARY OF THE INVENTION

Accordingly the present invention mainly contemplates an inexpensive high-frequency distribution circuit capable of preventing variation in level of a received signal, poor isolation and the like attributed to whether an output terminal is used or not.

The present high-frequency distribution circuit is a high-frequency distribution circuit that distributes to a plurality of output terminals a high-frequency signal received at an input terminal, and includes: a plurality of high-frequency lines associated with the plurality of output terminals, respectively, and each having one end connected to the input terminal; a terminator resistor associated with each high-frequency line; and a switch circuit associated with each high-frequency line, and passing a high-frequency signal from the other end of an associated high-frequency line to an associated output terminal if a load circuit is connected to the associated output terminal, and grounding the other end of the associated high-frequency line via an associated terminator resistor if the load circuit is not connected to the associated output terminal.

The present invention provides another high-frequency distribution circuit that has a plurality of input terminals and a plurality of output terminals and selects a high-frequency signal of a plurality of high-frequency signals, which are provided to the plurality of input terminals, for each output terminal to provide the selected high-frequency signal to the output terminal, and includes: a plurality of high-frequency lines associated with the plurality of output terminals, respectively; a select circuit selecting a high-frequency signal of a plurality of high-frequency signals, which are provided to the plurality of input terminals, for each high-frequency line to provide the selected high-frequency signal to one end of the high-frequency line; a terminator resistor associated with each high-frequency line; and a switch circuit associated with each high-frequency line, and passing a high-frequency signal from the other end of an associated high-frequency line to an associated output terminal if a load circuit is connected to the associated output terminal, and grounding the other end of the associated high-frequency line via an associated terminator resistor if the load circuit is not connected to the associated output terminal.

Preferably the high-frequency distribution circuit further includes a control circuit associated with each output terminal, and outputting a first signal if a load circuit is connected to an associated output terminal, and outputting a second signal if the load circuit is not connected to the associated output terminal, wherein the switch circuit passes a high-frequency signal from the other end of the associated high-frequency line to the associated output terminal if an associated control circuit outputs the first signal, and the switch circuit grounds the other end of the associated high-frequency line via the associated terminator resistor if the associated control circuit outputs the second signal.

Still preferably the load circuit applies a power supply voltage to the output terminal in response to the load circuit being connected to the output terminal; and the control circuit outputs the first signal if the power supply voltage is applied to the associated output terminal, and the control circuit outputs the second signal if the power supply voltage is not applied to the associated output terminal Still preferably the switch circuit includes a SPDT including a common terminal connected to the other end of the associated high-frequency line, a first conduction terminal connected to the associated output terminal, a second conduction terminal connected to one end of the terminator resistor, and a control terminal, and if a first voltage is applied to the control terminal, the common terminal and the first conduction terminal are electrically connected, and if a second voltage is applied to the control terminal, the common terminal and the second conduction terminal are electrically connected; the terminator resistor has the other terminal grounded; and the first signal is the first voltage applied to the first control terminal and the second signal is the second voltage applied to the control terminal.

Still preferably the high-frequency distribution circuit further includes: a subordinate terminator resistor associated with each SPDT; and a subordinate SPDT associated with each SPDT, and including a subordinate common terminal connected to a first conduction terminal of an associated SPDT, a first subordinate conduction terminal connected to an associated output terminal, a second subordinate conduction terminal connected to one terminal of an associated subordinate terminator resistor, and a subordinate control terminal, the subordinate SPDT having the subordinate common terminal and the first subordinate conduction terminal electrically connected when the first voltage is applied to the subordinate control terminal, the subordinate SPDT having the subordinate common terminal and the second subordinate conduction terminal electrically connected when the second voltage is applied to the subordinate control terminal. The subordinate terminator resistor has the other terminal grounded and equal voltage is applied to the subordinate control terminal of the subordinate SPDT and the control terminal of the associated SPDT.

Still preferably the switch circuit includes a switching element connected in series to an associated terminator resistor between the other end of an associated high-frequency line and a line of a ground potential, and not conducting if the control circuit outputs the first signal and conducting if the control circuit outputs the second signal.

Still preferably the high-frequency distribution circuit further includes: a subordinate terminator resistor associated with each switching element; and a subordinate switching element connected in series to an associated subordinate terminator resistor between the other end of an associated high-frequency line and a line of ground potential, and not conducting if the control circuit outputs the first signal and conducting if the control circuit outputs the second signal.

Still preferably the high-frequency distribution circuit further includes an amplifier associated with each high-frequency line, and receiving a high-frequency signal from the other end of an associated high-frequency line to amplify the high-frequency signal and provides an associated output terminal with the high-frequency signal amplified, wherein the control circuit activates an associated amplifier if the load circuit is connected to the associated output terminal, and the control circuit inactivates the amplifier if the load circuit is disconnected from the associated output terminal.

Still preferably the high-frequency distribution circuit further includes: a subordinate terminator resistor associated with each switch circuit; and a subordinate switch circuit associated with each switch circuit and disposed between an associated switch circuit and an associated output terminal, and passing a high-frequency signal having passed through the associated switch circuit to the associated output terminal if the load circuit is connected to the associated output terminal, and guiding a high-frequency signal, which has leaked from the associated switch circuit, via an associated subordinate terminator resistor to a line of ground potential if the load circuit is disconnected from the associated output terminal.

Still preferably the high-frequency distribution circuit is configured as a discrete circuit.

Still preferably the high-frequency distribution circuit is configured as an integrated circuit.

The present high-frequency distribution circuit is provided with a switch circuit which passes a high-frequency signal form the other end of a high-frequency line to an output terminal if a load circuit is connected to the output terminal and which grounds the other end of the high-frequency line via a terminator resistor if the load circuit is not connected to the output terminal. Variation in level of a received signal, poor isolation and the like attributed to whether the output terminal is used or not can be prevented. Furthermore, lower price can be achieved than when a termination is used.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
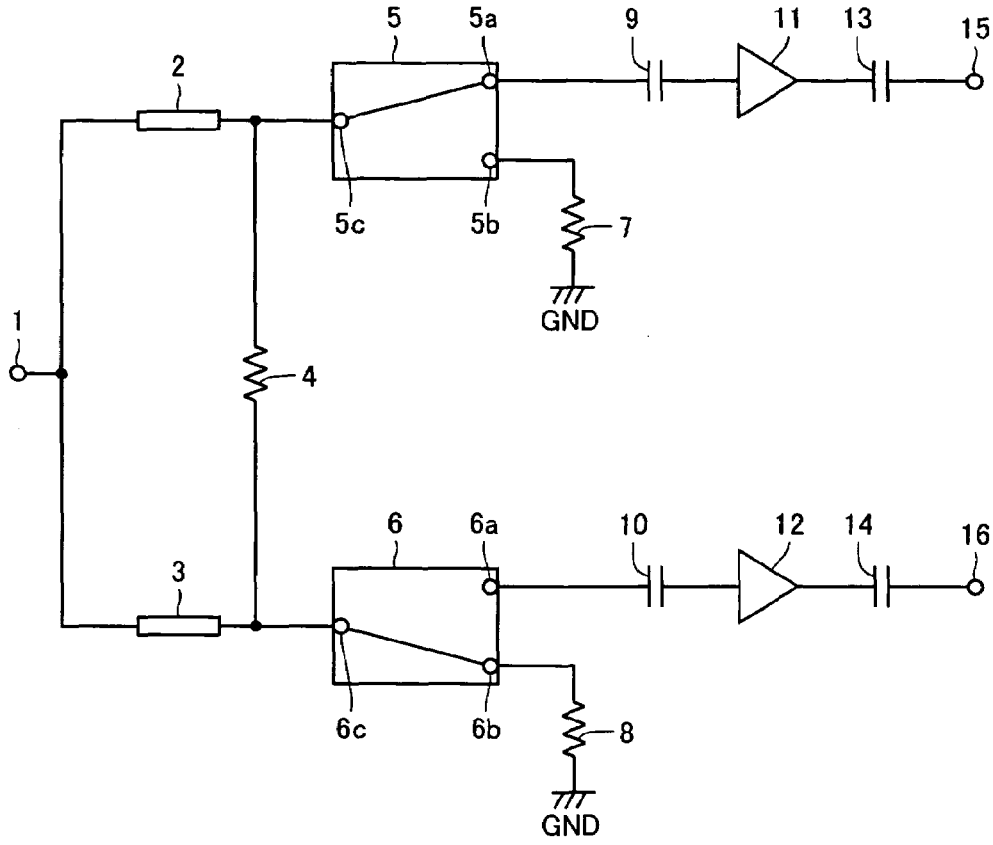
FIGS. 1-4 are circuit diagrams showing configurations of the present high-frequency distribution circuit in first to fourth embodiments, respectively.

FIG. 1 is a circuit diagram showing a configuration of the present high-frequency distribution circuit in a first embodiment. In FIG. 1 the high-frequency distribution circuit is provided in a LNB, a SW-BOX or the like and includes an input terminal 1, high-frequency lines 2 and 3, a resistor 4, switch circuits 5 and 6, terminator resistors 7 and 8, capacitors 9, 10, 13 and 14, amplifiers 11 and 12, and output terminals 15 and 16.

High-frequency lines 2 and 3 each have one end connected to input terminal 1, and have their respective other ends connected to switch circuits 5 and 6 at common terminals 5*c* and 6*c*, respectively. Resistor 4 has a sufficiently larger value in resistance than terminator resistors 7 and 8 and is connected between the other ends of high-frequency lines 2 and 3, respectively. High-frequency lines 2 and 3 is equal in dimension and characteristic impedance (e.g., 75Ω).

Switch circuit 5 has a first conduction terminal 5*a* connected via capacitor 9 to an input node of amplifier 11, and amplifier 11 has an output node connected via capacitor 13 to output terminal 15. Terminator resistor 7 is connected between a second conduction terminal 5*b* of switch circuit 5 and a ground potential GND line. Terminator resistor 7 has a value in resistance (of 75Ω) equal in value to the characteristic impedance of high-frequency line 2.

If output terminal 15 is connected via a coaxial cable to receiver 104, switch circuit 5 conducts via common terminal 5*c* and the first conduction terminal 5*a*. Note that the coaxial cable connected to output terminal 15 has a characteristic impedance of 75Ω and receiver 104 has an input resistance value of 75Ω for the sake of illustration. High-frequency line 2 passes a high-frequency signal which is in turn transmitted via switch circuit 5, capacitor 9, amplifier 11, capacitor 13, output terminal 15 and the coaxial cable to receiver 104.

If output terminal 15 is not connected to receiver 104, switch circuit 5 conducts via common terminal 5*c* and the second conduction terminal 5*b* and high-frequency line 2 has the other end grounded via terminator resistor 7. Whether output terminal 15 may be connected via the coaxial line to receiver 104 or may not be connected to receiver 104, an impedance of 75Ω is provided, as seen at input terminal 1 toward output terminal 15, and does not vary. Note that switch circuit 5 may manually be switched, or may be switched by a control circuit, as described later.

Switch circuit 6 has a first conduction terminal 6*a* connected via capacitor 10 to an input node of amplifier 12, and amplifier 12 has an output node connected via capacitor 14 to output terminal 16. Terminator resistor 8 is connected between a second conduction terminal 6*b* of switch circuit 6 and a ground potential GND line. Terminator resistor 8 has a value in resistance (of 75Ω) equal in value to the characteristic impedance of high-frequency line 3.

If output terminal 16 is connected via a coaxial cable to receiver 105, switch circuit 6 conducts via common terminal 6*c* and the first conduction terminal 6*a*. Note that the coaxial cable connected to output terminal 16 has a characteristic impedance of 75Ω and receiver 105 has an input resistance value of 75Ω for the sake of illustration. High-frequency line 3 passes a high-frequency signal which is in turn transmitted via switch circuit 6, capacitor 10, amplifier 12, capacitor 14, output terminal 16 and the coaxial cable to receiver 105.

If output terminal 16 is not connected to receiver 105, switch circuit 6 conducts via common terminal 6*c* and the second conduction terminal 6*b* and high-frequency line 3 has the other end grounded via terminator resistor 8. Whether output terminal 16 may be connected via the coaxial line to receiver 105 or may not be connected to receiver 105, an impedance of 75Ω is provided, as seen at input terminal 1 toward output terminal 16, and does not vary. Note that switch circuit 6 may manually be switched, or may be switched by a control circuit, as described later.

The high-frequency distribution circuit operates as described hereinafter. If output terminals 15 and 16 are connected to receivers 104 and 105, respectively, switch circuit 5 conducts via common terminal 5*c* and the first conduction terminal 5*a* and switch circuit 6 conducts via common terminal 6*c* and the first conduction terminal 6*a*. In that case, the value in resistance as seen at input terminal 1 toward output terminal 15 and that as seen at input terminal 1 towards output terminal 16 are both 75Ω, and a high-frequency signal received at input terminal 1 is distributed to the two output terminals 15 and 16 equally.

If output terminal 15 is connected to receiver 104 and output terminal 16 is not connected to receiver 105, switch circuit 5 conducts via common terminal 5*c* and the first conduction terminal 5*a* and switch circuit 6 conducts via common terminal 6*c* and the second conduction terminal 6*b*. In that case the value in resistance as seen at input terminal toward output terminal 15 and that as seen at input terminal 1 toward output terminal 16 are also both 75Ω and a high-frequency signal received at input terminal 1 is distributed toward output terminals 15 and 16 equally. This also applies if output terminal 16 is connected to receiver 15 and output terminal 15 is not connected to receiver 104. Whether one of output terminals 15 and 16 may be connected to a receiver or not, a high-frequency signal is reliably distributed.

In the first embodiment if output terminals 15 and 16 are connected to receivers 104 and 105, a high-frequency signal is passed from the other ends of high-frequency lines 2 and 3, respectively, to output terminals 15 and 16, and if output terminals 15 and 16 are not connected to receiver 104 and 105 then high-frequency lines 2 and 3 have their respective other ends grounded via terminator resistors 7 and 8. This can prevent variation in level of a received signal, poor isolation and the like attributed to whether output terminals 15 and 16 are connected to receivers 104 and 105. Furthermore, better operability can be provided than when a termination is used. An externally attached component can be dispensed with, and improved workability and lower price can be achieved.

Note that while in the first embodiment the characteristic impedance of high-frequency lines 2 and 3 and the value in resistance of terminator resistors 7 and 8 are equal to that of receivers 104 and 105, or 75Ω, the former may have a value different from the latter, (e.g. 50Ω) and an impedance converter converting 50Ω to 75Ω may be provided between amplifiers 11 and 12 and output terminals 15 and 16.

Second Embodiment

Figure 2:
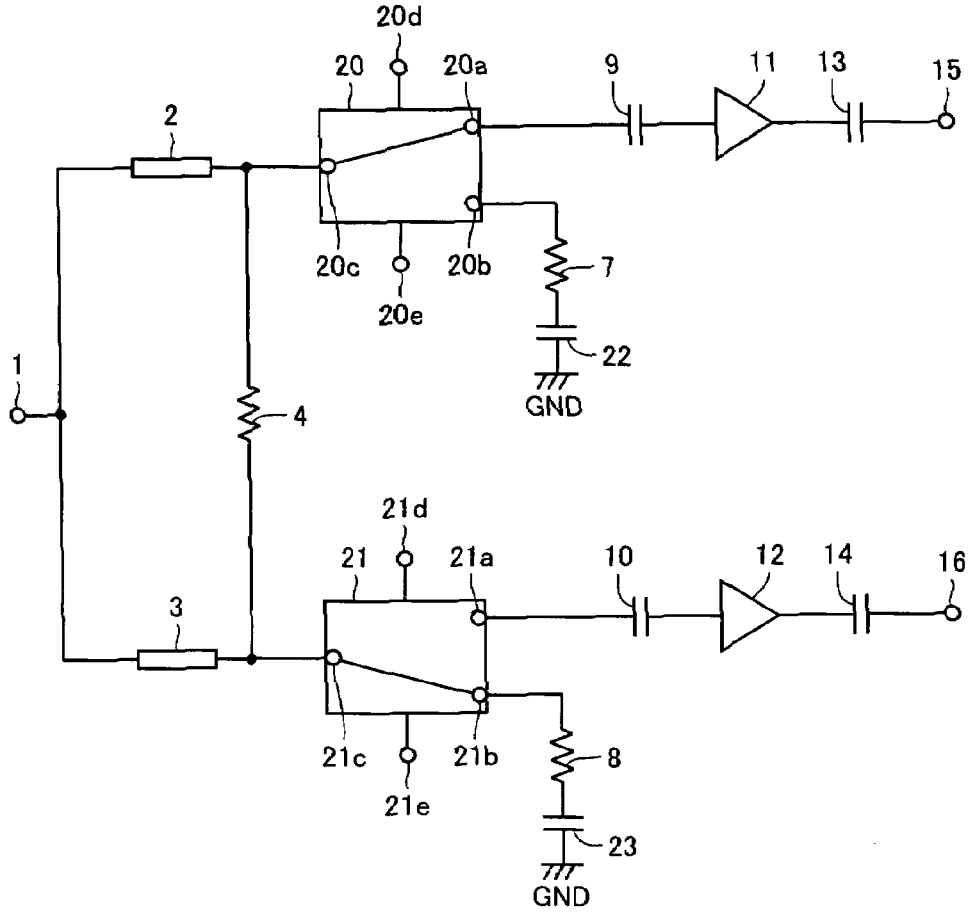

FIG. 2 is a circuit diagram showing a configuration of the present high-frequency distribution circuit in a second embodiment. The high-frequency distribution circuit of FIG. 2 corresponds to that of FIG. 1 with switch circuits 5 and 6 of FIG. 1 implemented by single pole double throws (SPDTs) 20 and 21, respectively.

SPDT 20 includes a common terminal 20*c*, first and second conduction terminals 20*a* and 20*b*, and first and second control terminals 20*d* and 20*e*. Common terminal 20*c* is connected to the other end of high-frequency line 2. The first conduction terminal 20*a* is connected via capacitor 9 to an input node of amplifier 11. The second conduction terminal 20*b* is connected via terminator resistor 7 and a capacitor 22 to a ground potential GND line. Capacitor 22 is provided to prevent a direct current (dc) current from flowing from the second conduction terminal 20*b* to the ground potential GND line and has a sufficiently low impedance for a high-frequency signal.

If output terminal 15 is connected via a coaxial cable to receiver 104, SPDT 20 receives a high level (3V) and a low level (0V) at the first and second control terminals 20*d* and 20*e*, respectively, and conducts via common terminal 20*c* and the first conduction terminal 20*a*.

If output terminal 15 is not connected to receiver 104, SPDT 20 receives the low and high levels at the first and second control terminals 20*d* and 20*e*, respectively, and conducts via common terminal 20*c* and the second conduction terminal 20*b*, and high-frequency line 2 has the other end grounded via terminator resistor 7.

SPDT 21 includes a common terminal 21*c* , first and second conduction terminals 21*a* and 21*b*, and first and second control terminals 21*d* and 21*e*. Common terminal 21*c* is connected to the other end of high-frequency line 3. The first conduction terminal 21*a* is connected via capacitor 10 to an input node of amplifier 12. The second conduction terminal 21*b* is connected via terminator resistor 8 and a capacitor 23 to a ground potential GND line. Capacitor 23 is provided to prevent a direct current (dc) current from flowing from the second conduction terminal 21*b* to the ground potential GND line and has a sufficiently low impedance for a high-frequency signal.

If output terminal 16 is connected via a coaxial cable to receiver 105, SPDT 21 receives the high and low levels at the first and second control terminals 21*d* and 21*e*, respectively, and conducts via common terminal 21*c* and the first conduction terminal 21*a*.

If output terminal 16 is not connected to receiver 105, SPDT 21 receives the low and high levels at the first and second control terminals 21*d* and 21*e*, respectively, and conducts via common terminal 21*c* and the second conduction terminal 21*b*, and high-frequency line 3 has the other end grounded via terminator resistor 8. The remainder in configuration and operation is identical to that described in the first embodiment. Accordingly it will not be described repeatedly.

The second embodiment can provide the same effect as the first embodiment. Note that the use of the SPDT contributes to increased current consumption, which, however, is as small as negligible.

Third Embodiment

Figure 3:
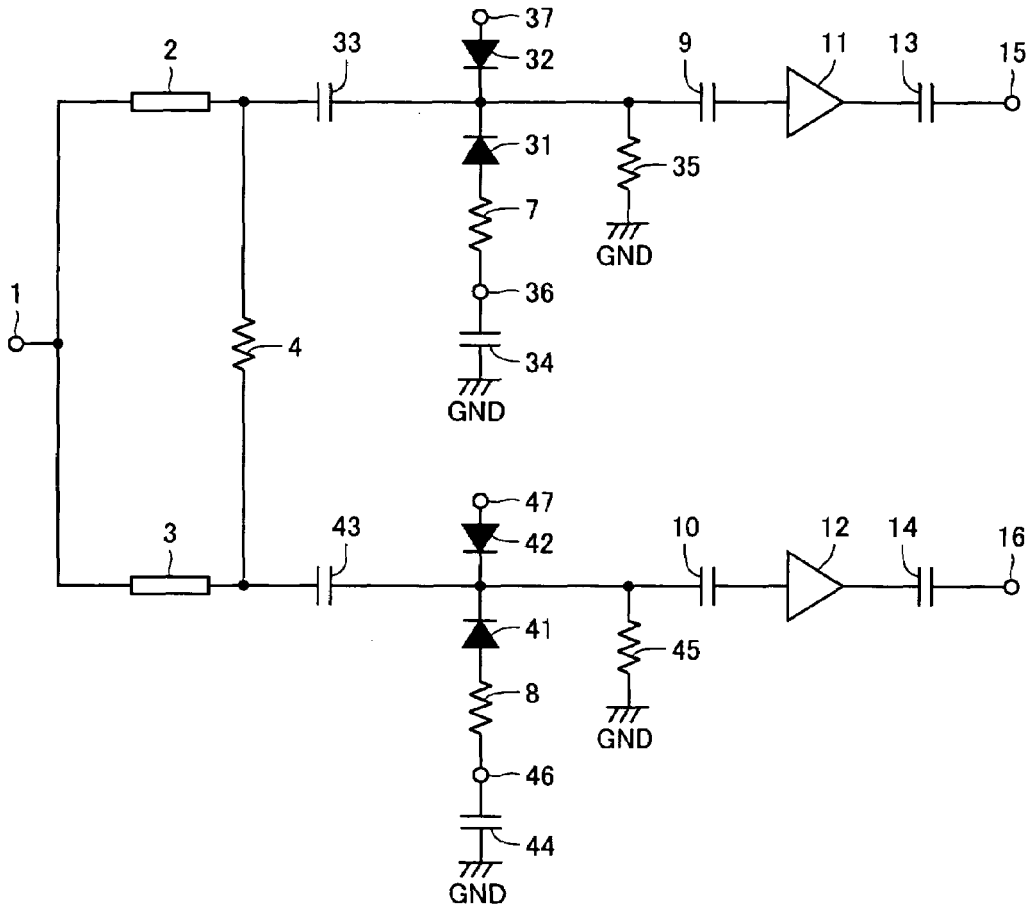

FIG. 3 is a circuit diagram showing a configuration of the present high-frequency distribution circuit in a third embodiment. The high-frequency distribution circuit of FIG. 3 corresponds to that of FIG. 1 with switch circuit 5 of FIG. 1 configured of PIN diodes 31 and 32, capacitors 33 and 34, a resistor 35 and first and second control terminals 36 and 37, and switch circuit 6 configured of PIN diodes 41 and 42, capacitors 43 and 44, a resistor 45 and first and second control terminals 46 and 47.

Capacitor 33 is connected between the other end of high-frequency line 2 and capacitor 9. Diode 31 has an anode connected to one terminal of terminator resistor 7 and has a cathode connected to a node located between capacitors 9 and 33. Diode 31 has resistance set to have a sufficiently small value when it conducts. Terminator resistor 7 has the other terminal connected via the first control terminal 36 and capacitor 34 to a ground potential GND line. Capacitor 34 is provided to prevent a dc current from flowing from first control terminal 36 to the ground potential GND line and has a sufficiently low impedance for a high-frequency signal. Diode 32 has an anode connected to the second terminal 37 and a cathode connected to that of diode 31. Diode 32 has resistance set to have a sufficiently large value when it conducts. Resistor 35 has a value in resistance sufficiently larger than terminator resistors 7 and 8 and is connected between the cathodes of diodes 31 and 32 and the ground potential GND line.

If output terminal 15 is connected via a coaxial cable to receiver 104, the first control terminal 36 receives a first voltage V1 and the second control terminal 37 receives a second voltage V2 higher than the first voltage V1, and diode 32 conducts and diode 31 does not conduct. This allows a dc current to flow from the second control terminal 37 via diode 32 and resistor 35 to the ground potential GND line. Furthermore, as diode 32 and resistor 35 are sufficiently high in resistance, a high-frequency signal passing through high-frequency line 2 is output via capacitors 33 and 9, amplifier 11 and capacitor 13 to output terminal 15.

If output terminal 15 is not connected to receiver 104, the first control terminal 36 receives the first voltage V1 and the second control terminal 37 receives a third voltage V3 lower than the first voltage V1, and diode 31 conducts and diode 32 does not conduct. This allows a dc current to flow from the first control terminal 36 via terminator resistor 7, diode 31 and resistor 35 to the ground potential GND line. Furthermore, as capacitor 33, diode 31 and capacitor 34 have an impedance set to have a sufficiently lower value than terminator resistor 7 does, high-frequency line 2 has the other end grounded via capacitor 33, diode 31, terminator resistor 7 and capacitor 34 for high frequency.

Capacitor 43 is connected between the other end of high-frequency line 3 and capacitor 10. Diode 41 has an anode connected to one terminal of terminator resistor 8 and has a cathode connected to a node located between capacitors 10 and 43. Diode 41 has resistance set to have a sufficiently small value when it conducts. Terminator resistor 8 has the other terminal connected via the first control terminal 46 and capacitor 44 to a ground potential GND line. Capacitor 44 is provided to prevent a dc current from flowing from first control terminal 46 to the ground potential GND line and has a sufficiently low impedance for a high-frequency signal. Diode 42 has an anode connected to the second terminal 47 and a cathode connected to that of diode 41. Diode 42 has resistance set to have a sufficiently large value when it conducts. Resistor 45 has a value in resistance sufficiently larger than terminator resistors 7 and 8 and is connected between the cathodes of diodes 41 and 42 and the ground potential GND line.

If output terminal 16 is connected via a coaxial cable to receiver 105, the first control terminal 46 receives the first voltage V1 and the second control terminal 47 receives the second voltage V2 higher than the first voltage V1, and diode 42 conducts and diode 41 does not conduct. This allows a dc current to flow from the second control terminal 47 via diode 42 and resistor 45 to the ground potential GND line. Furthermore, as diode 42 and resistor 45 are sufficiently high in resistance, a high-frequency signal passing through high-frequency line 3 is output via capacitors 43 and 10, amplifier 12 and capacitor 14 to output terminal 16.

If output terminal 16 is not connected to receiver 105, the first control terminal 46 receives the first voltage V1 and the second control terminal 47 receives the third voltage V3 lower than the first voltage V1, and diode 41 conducts and diode 42 does not conduct. This allows a dc current to flow from the first control terminal 46 via terminator resistor 8, diode 41 and resistor 45 to the ground potential GND line. Furthermore, as capacitor 43, diode 41 and capacitor 44 have an impedance set to have a sufficiently lower value than terminator resistor 8 does, high-frequency line 3 has the other end grounded via capacitor 43, diode 41, terminator resistor 8 and capacitor 44 for high frequency. The remainder in configuration and operation is identical to that described in the first embodiment. Accordingly it will not be described repeatedly.

The third embodiment can provide the same effect as the first embodiment.

Fourth Embodiment

Figure 4:
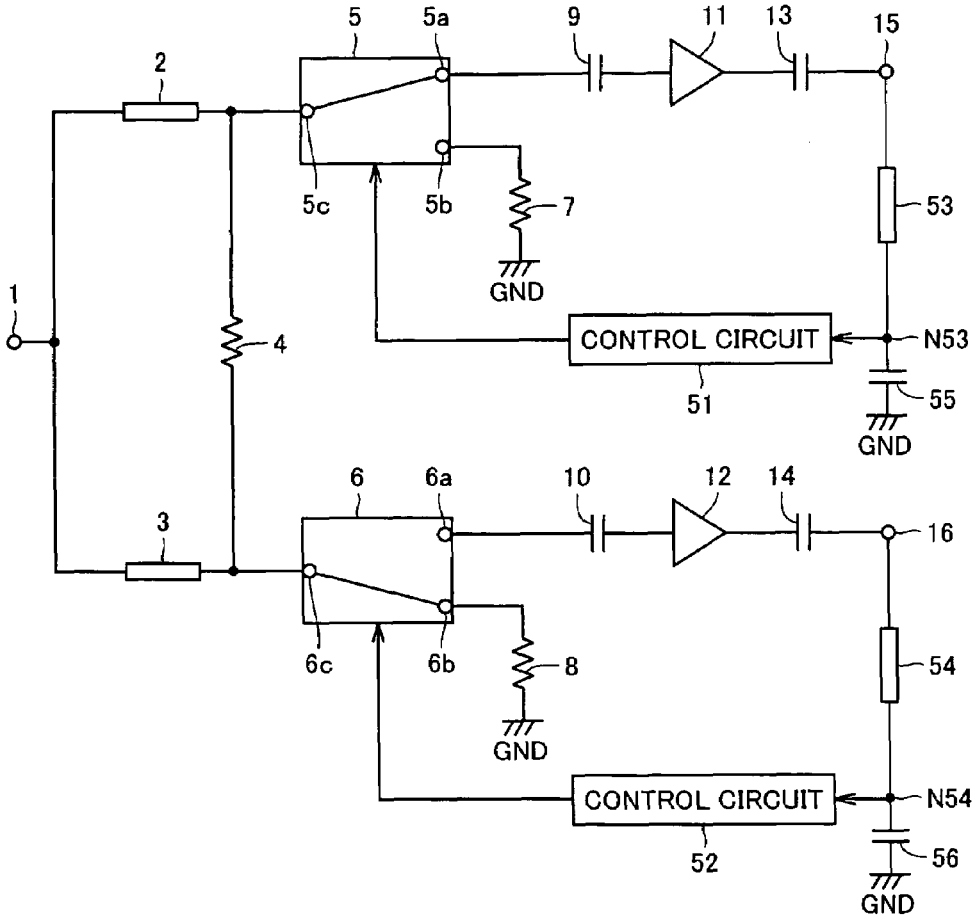

FIG. 4 is a circuit diagram showing a configuration of the present high-frequency distribution circuit in a fourth embodiment. The high-frequency distribution circuit of FIG. 4 corresponds to that of FIG. 1 plus control circuits 51 and 52, high-frequency lines 53 and 54, and capacitors 55 and 56.

High-frequency line 53 and capacitor 55 are connected in series between output terminal 15 and a ground potential GND line and configure a lowpass filter which prevents a high-frequency signal from passing therethrough and passes dc voltage therethrough. Control circuit 51 determines whether dc voltage is applied at a node N53 located between high-frequency line 53 and capacitor 55, and controls switch circuit 5 in accordance with the decision.

If output terminal 15 is connected via a coaxial cable to receiver 104, receiver 104 supplies an output terminal of an LNB, an SW-BOX or the like, i.e., output terminal 15 of the high-frequency distribution circuit, via the coaxial cable with dc voltage as a power supply voltage for the LNB, the SW-BOX or the like. Output terminal 15 receives the dc voltage which is in turn transmitted on high-frequency line 53 to node N53. As node N53 receives the dc voltage, control circuit 51 responsively controls switch circuit 5 to conduct via common terminal 5*c* and the first conduction terminal 5*a* to pass a high-frequency signal to output terminal 15.

If output terminal 15 is not connected to receiver 104, output terminal 15 and hence node N53 do not receive dc voltage. Responsively, control circuit 51 controls switch circuit 5 to conduct via common terminal 5*c* and the second conduction terminal 5*b* to terminate the other end of high-frequency line 2.

High-frequency line 54 and capacitor 56 are connected in series between output terminal 16 and a ground potential GND line and configure a lowpass filter which prevents a high-frequency signal from passing therethrough and passes dc voltage therethrough. Control circuit 52 determines whether dc voltage is applied at a node N54 located between high-frequency line 54 and capacitor 56, and controls switch circuit 6 in accordance with the decision.

If output terminal 16 is connected via a coaxial cable to receiver 105, receiver 105 supplies an output terminal of the LNB, an SW-BOX or the like, i.e., output terminal 16 of the high-frequency distribution circuit, via the coaxial cable with dc voltage as a power supply voltage for the LNB, the SW-BOX or the like. Output terminal 16 receives the dc voltage which is in turn transmitted on high-frequency line 54 to node N54. As node N54 receives the dc voltage, control circuit 52 responsively controls switch circuit 6 to conduct via common terminal 6*c* and the first conduction terminal 6*a* to pass a high-frequency signal to output terminal 16.

If output terminal 16 is not connected to receiver 105, output terminal 16 and hence node N54 do not receive dc voltage. Responsively, control circuit 52 controls switch circuit 6 to conduct via common terminal 6*c* and the second conduction terminal 6*b* to terminate the other end of high-frequency line 3. The remainder in configuration and operation is identical to that described in the first embodiment. Accordingly it will not be described repeatedly.

The fourth embodiment can provide the same effect as the first embodiment. Furthermore, it can also prevent variation in level of a received signal, poor isolation and the like attributed to variation in impedance caused as receivers 104 and 105 connected to output terminals 15 and 16 are powered on/off.

Figure 5:
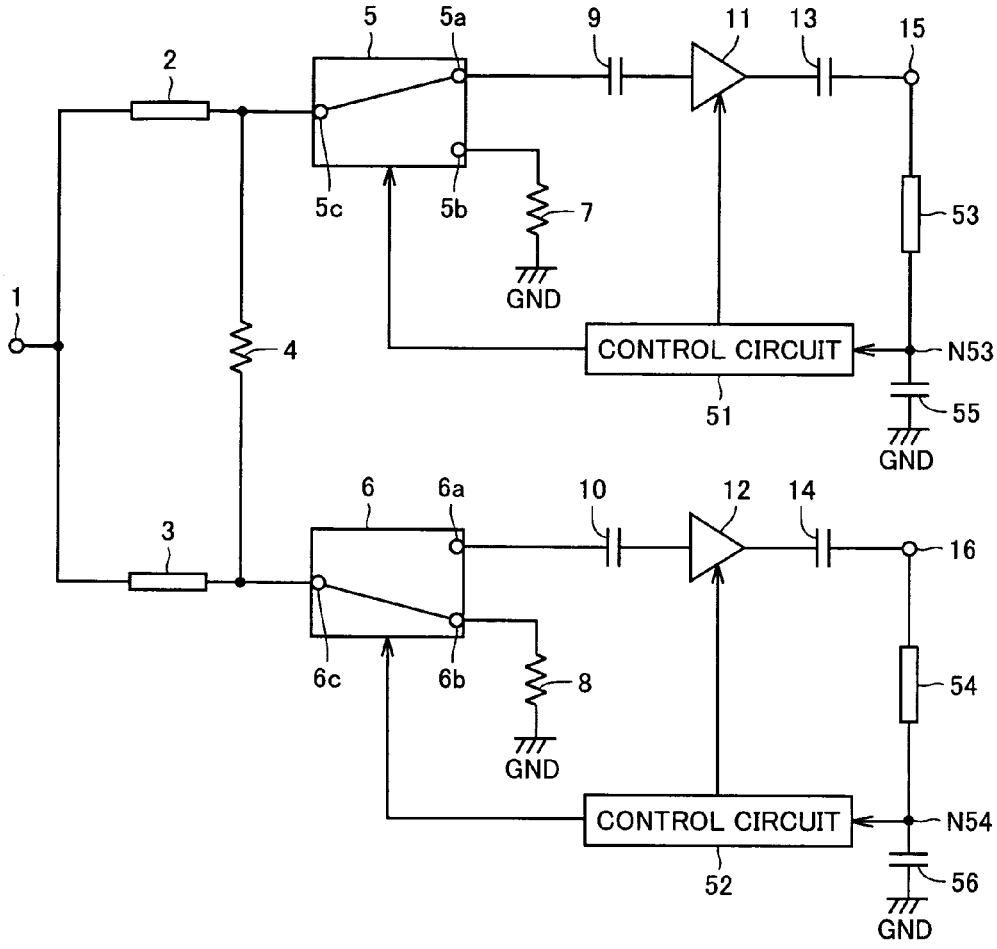
FIG. 5 is a circuit diagram showing an exemplary variation of the fourth embodiment.

FIG. 5 is a circuit diagram showing an exemplary variation of the fourth embodiment. In this exemplary variation if node N53 receives dc voltage, control circuit 51 controls switch circuit 5 to conduct via common terminal 5*c* and the first conduction terminal 5*a* and also activates amplifier 11. If node N53 does not receive dc voltage, control circuit 51 controls switch circuit 5 to conduct via common terminal 5*c* and the second conduction terminal 5*b* and also inactivates amplifier 11.

If node N54 receives dc voltage, control circuit 52 controls switch circuit 6 to conduct via common terminal 6*c* and the first conduction terminal 6*a* and also activates amplifier 12. If node N54 does not receive dc voltage, control circuit 52 controls switch circuit 6 to conduct via common terminal 6*c* and the second conduction terminal 6*b* and also inactivates amplifier 12. If amplifiers 11 and 12 are not required they can be inactivated. Reduced power consumption can thus be achieved.

Fifth Embodiment

Figure 6:
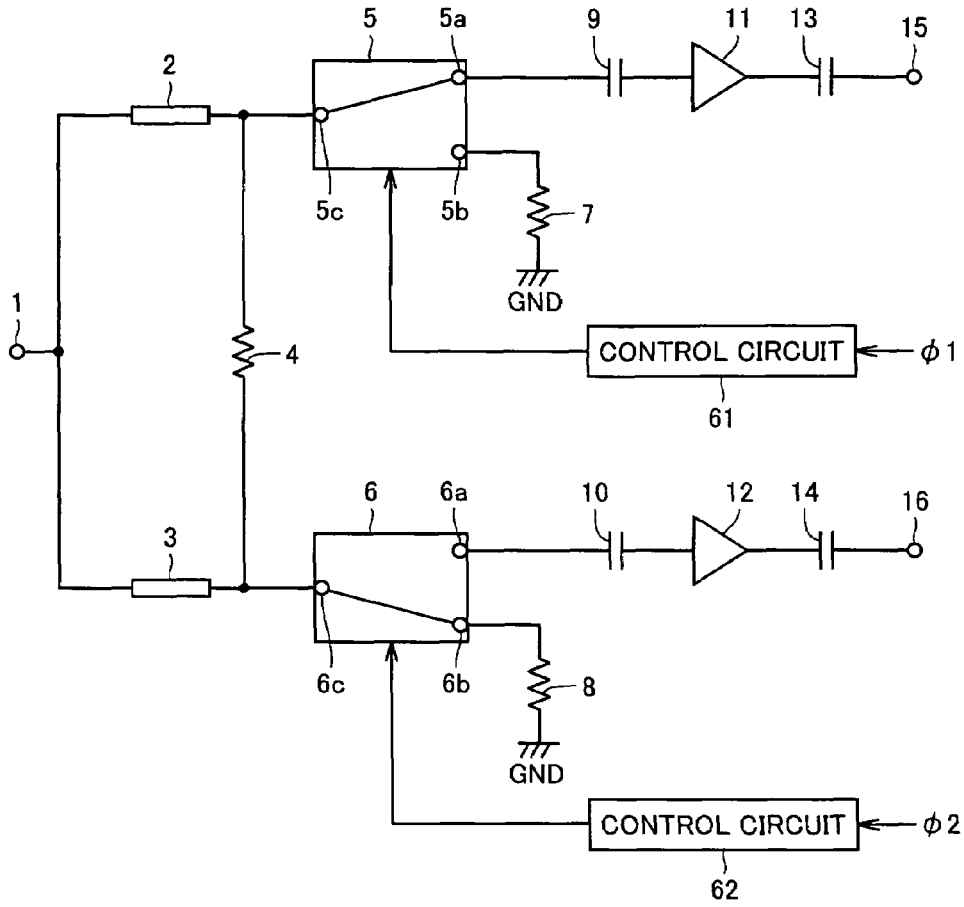
FIG. 6 is a circuit diagram showing a configuration of the present high-frequency distribution in a fifth embodiment.

FIG. 6 is a circuit diagram showing a configuration of the present high-frequency distribution circuit in a fifth embodiment. The high-frequency distribution circuit of FIG. 6 corresponds to that of FIG. 1 plus control circuits 61 and 62.

Control circuit 61 operates in response to a switch signal $\phi$1 to control switch circuit 5. Switch signal $\phi$1 may be applied from receiver 104, generated in the high-frequency distribution circuit in response to detecting that a coaxial cable is connected to output terminal 15, or generated in response to a user instruction.

If output terminal 15 is connected via the coaxial cable to receiver 104, switch signal $\phi$1 is set high. In response to signal $\phi$1 set high, control circuit 61 applies a first control signal to switch circuit 5 to control switch circuit 5 to conduct via common terminal 5*c* and the first conduction terminal 5*a* to pass a high-frequency signal to output terminal 15.

If output terminal 15 is not connected to receiver 104, switch signal $\phi$1 is set low. In response to signal $\phi$1 set low, control circuit 61 applies a second control signal to switch circuit 5 to control switch circuit 5 to conduct via common terminal 5*c* and the second conduction terminal 5*b* to pass a high-frequency signal to terminate the other end of high-frequency line 2.

Control circuit 62 operates in response to switch signal $\phi$2 to control switch circuit 6. Switch signal $\phi$2 is generated in the same method as switch signal $\phi$1.

If output terminal 16 is connected via the coaxial cable to receiver 105, switch signal $\phi$2 is set high. In response to signal $\phi$2 set high, control circuit 62 applies the first control signal to switch circuit 6 to control switch circuit 6 to conduct via common terminal 6*c* and the first conduction terminal 6*a* to pass a high-frequency signal to output terminal 16.

If output terminal 16 is not connected to receiver 105, switch signal $\phi$2 is set low. In response to signal $\phi$2 set low, control circuit 62 applies the second control signal to switch circuit 6 to control switch circuit 6 to conduct via common terminal 6*c* and the second conduction terminal 6*b* to pass a high-frequency signal to terminate the other end of high-frequency line 3. The remainder in configuration and operation is identical to that described in the first embodiment. Accordingly it will not be described repeatedly.

The fifth embodiment can provide the same effect as the first embodiment.

Figure 7:
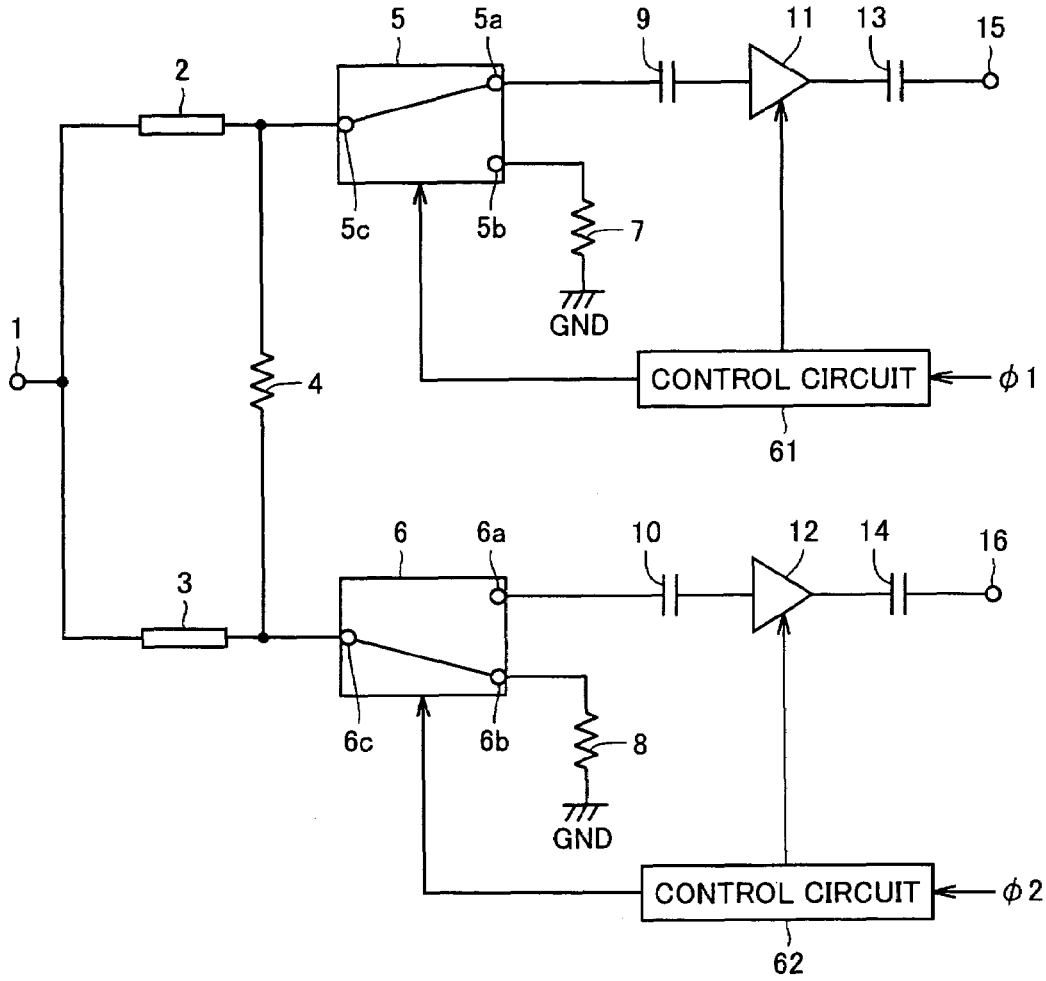
FIG. 7 is a circuit diagram showing an exemplary variation of the fifth embodiment.

FIG. 7 is a circuit diagram showing an exemplary variation of the fifth embodiment. In this exemplary variation control circuit 61 operates in response to switch signal $\phi$1 having the high level to control switch circuit 5 to conduct via common terminal 5*c* and the first conduction terminal 5*a*, and also to activate amplifier 11. Furthermore control circuit 61 operates in response to switch signal $\phi$1 having the low level to control switch circuit 5 to conduct via common terminal 5*c* and the second conduction terminal 5*b*, and also to inactivate amplifier 11.

Control circuit 62 operates in response to switch signal $\phi$2 having the high level to control switch circuit 6 to conduct via common terminal 6*c* and the first conduction terminal 6*a*, and also to activate amplifier 12. Furthermore control circuit 62 operates in response to switch signal $\phi$2 having the low level to control switch circuit 6 to conduct via common terminal 6*c* and the second conduction terminal 6*b*, and also to inactivate amplifier 12. If amplifiers 11 and 12 are not required they can be inactivated. Reduced power consumption can thus be achieved.

Sixth Embodiment

Figure 8:
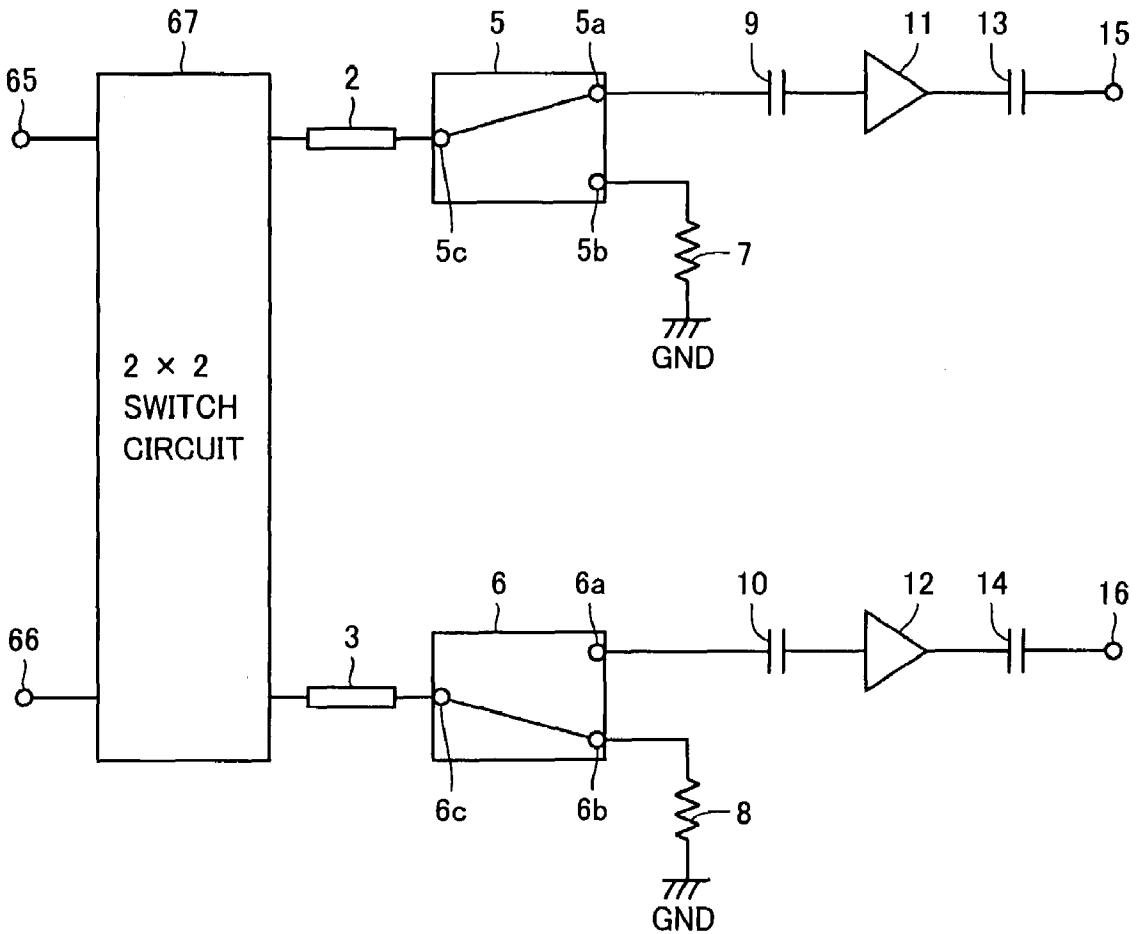
FIG. 8 is a circuit diagram showing a configuration of the present high-frequency distribution in a sixth embodiment.

FIG. 8 is a circuit diagram showing a configuration of the present high-frequency distribution circuit in a sixth embodiment. The high-frequency distribution circuit of FIG. 8 differs from that of FIG. 1 in that input terminal 1 and resistor 4 are removed and input terminal 65 and 66 and a 2×2 switch circuit 67 are introduced. Input terminals 65 and 66 receive different high-frequency signals, respectively. 2×2 switch circuit 67 selects for one output terminal 15 one of two such high-frequency signals provided to the two input terminals 65 and 66 and provides the selected high-frequency signal to output terminal 15. Furthermore 2×2 switch circuit 67 selects for the other output terminal 16 one of two such high-frequency signals provided to the two input terminals 65 and 66 and provides the selected high-frequency signal to output terminal 16. As such, output terminals 15 and 16 may receive identical high-frequency signals, respectively, or may receive different high-frequency signals, respectively.

If this high-frequency distribution circuit also has output terminals 15 and 16 with receivers 104 and 105 connected thereto, it passes a high-frequency signal from the other ends of high-frequency lines 2 and 3 to output terminals 15 and 16, If the high-frequency distribution circuit has output terminals 15 and 16 without receivers 104 and 105 connected thereto, high-frequency lines 2 and 3 have their respective other ends grounded via terminator resistors 7 and 8, respectively. This can prevent variation in level of a received signal, poor isolation and the like attributed to whether output terminals 15 and 16 are connected to receivers 104 and 105. Furthermore, better operability can be provided than when a termination is used. An externally attached component can be dispensed with, and improved workability and lower price can be achieved.

Note that it is needless to say that as shown in FIGS. 9-14, the high-frequency distribution circuits of FIGS. 2-7 with input terminal 1 and resistor 4 replaced with input terminals 65 and 66 and 2×2 switch circuit 67 are equally effective.

Seventh Embodiment

If, for the high-frequency distribution circuit of FIG. 8, one desires for example that a high-frequency signal provided to input terminal 65 be provided to output terminal 15 alone, a portion of the high-frequency signal would leak via 2×2 switch circuit 67 toward output terminal 16. The leaked high-frequency signal is terminated at switch circuit 6 and terminator resistor 8. However, a portion of the leaked high-frequency signal further leaks via switch circuit 6 to output terminal 16. If output terminal 16 has a varying impedance connected thereto, the impedance's variation causes the high-frequency signal leaking toward output terminal 16 to vary in amplitude and as a result a high-frequency signal at output terminal 15 would have a varied amplitude. A seventh embodiment addresses such disadvantage.

Figure 15:
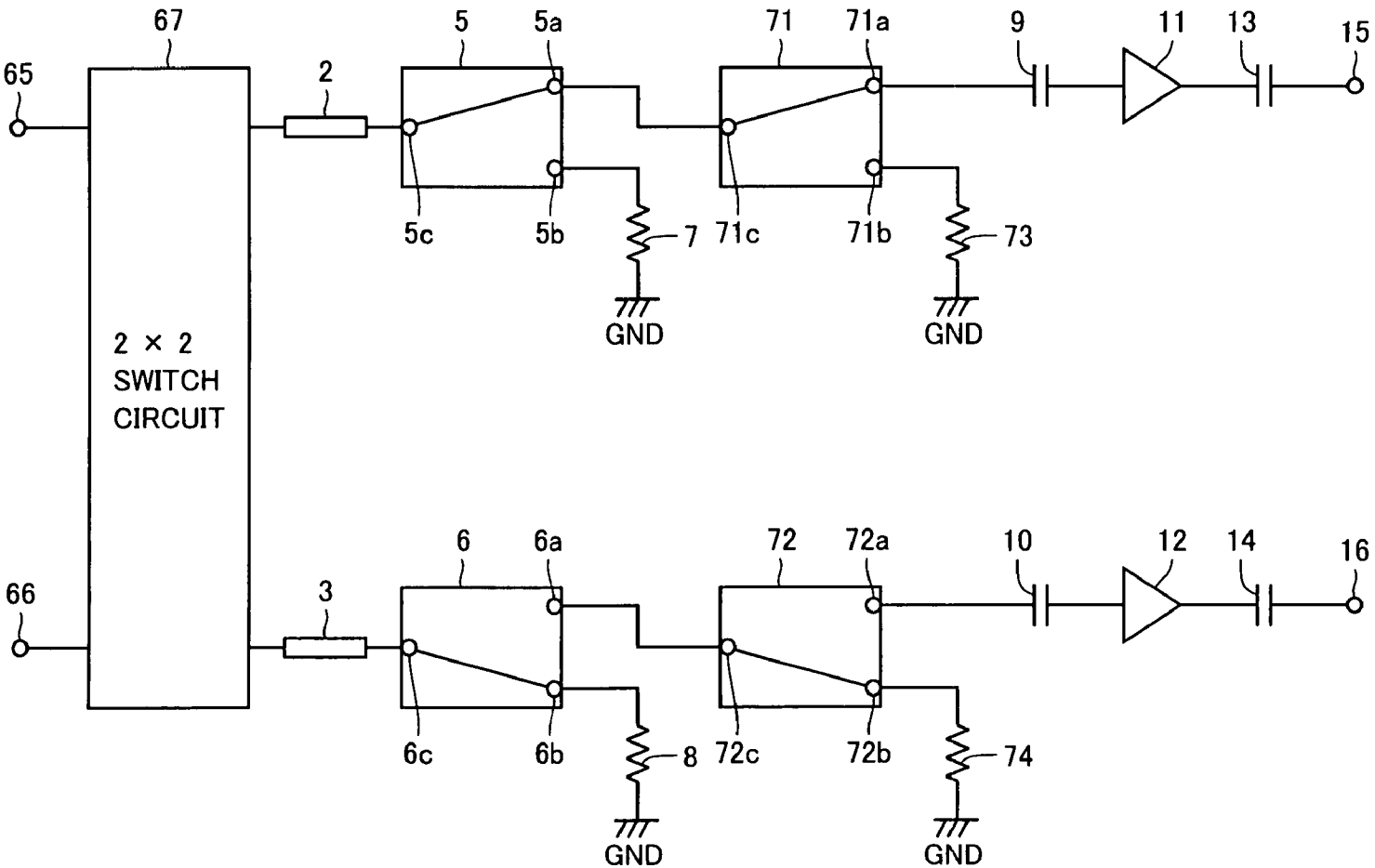
FIG. 15 is a circuit diagram showing a configuration of the present high-frequency distribution in a seventh embodiment.

FIG. 15 is a circuit diagram showing a configuration of the present high-frequency distribution circuit in the seventh embodiment in comparison with FIG. 8. The high-frequency distribution circuit of FIG. 15 differs from that of FIG. 8 in that the former has switch circuits 71 and 72 and terminator resistors 73 and 74 added thereto.

Switch circuit 5 has the first conduction terminal 5*a* connected to switch circuit 71 at a common terminal 71*c*. Switch circuit 71 has a first conduction terminal 71*a* connected via capacitor 9 to amplifier 11 at an input node. Switch circuit 71 has a second conduction terminal 71*b* connected via terminator resistor 73 to a ground potential GND line. Switch circuits 5 and 71 are similarly switched. When switch circuit 5 conducts via terminals 5*a* and 5*c*, switch circuit 71*c* conducts via terminals 71*a* and 71*c*. When switch circuit 5 conducts via terminals 5*b* and 5*c*, switch circuit 71 conducts via terminals 71*b* and 71*c*.

Switch circuit 6 has the first conduction terminal 6*a* connected to switch circuit 72 at a common terminal 72*c*. Switch circuit 71 has a first conduction terminal 72*a* connected via capacitor 10 to amplifier 12 at an input node. Switch circuit 72 has a second conduction terminal 72*b* connected via terminator resistor 74 to a ground potential GND line. Switch circuits 6 and 72 are similarly switched. When switch circuit 6 conducts via terminals 6*a* and 6*c*, switch circuit 72 conducts via terminals 72*a* and 72*c*. When switch circuit 6 conducts via terminals 6*b* and 6*c*, switch circuit 72 conducts via terminals 72*b* and 72*c*.

If one desires that a high-frequency signal provided to input terminal 65 be provided to output terminal 15 alone, a portion of the high-frequency signal would leak via 2×2 switch circuit 67 toward output terminal 16. The leaked high-frequency signal is terminated at switch circuit 6 and terminator resistor 8. However, a portion of the leaked high-frequency signal further leaks via switch circuit 6 toward switch circuit 72. The high-frequency signal having leaked from switch 6 is terminated at switch circuit 72 and terminator resistor 74. As a result, a high-frequency signal leaking to output terminal 16 can significantly be reduced in amplitude, and if a varying impedance is connected to output terminal 16, the effect that the variation of the impedance has on the amplitude of the high-frequency signal at output terminal 15 can be reduced.

Figure 9:
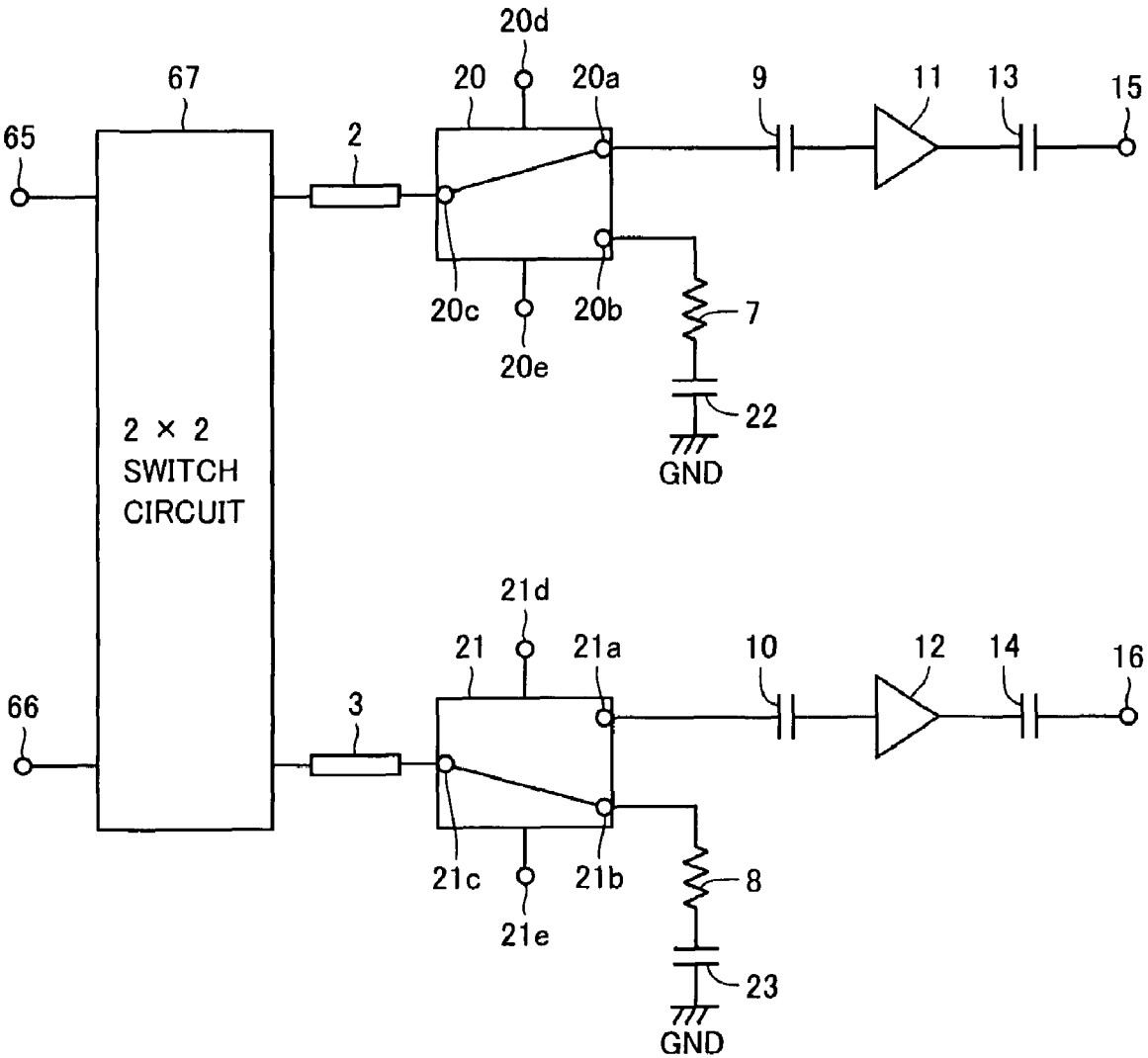
FIG. 9 is a circuit diagram showing an exemplary variation of the sixth embodiment.
Figure 16:
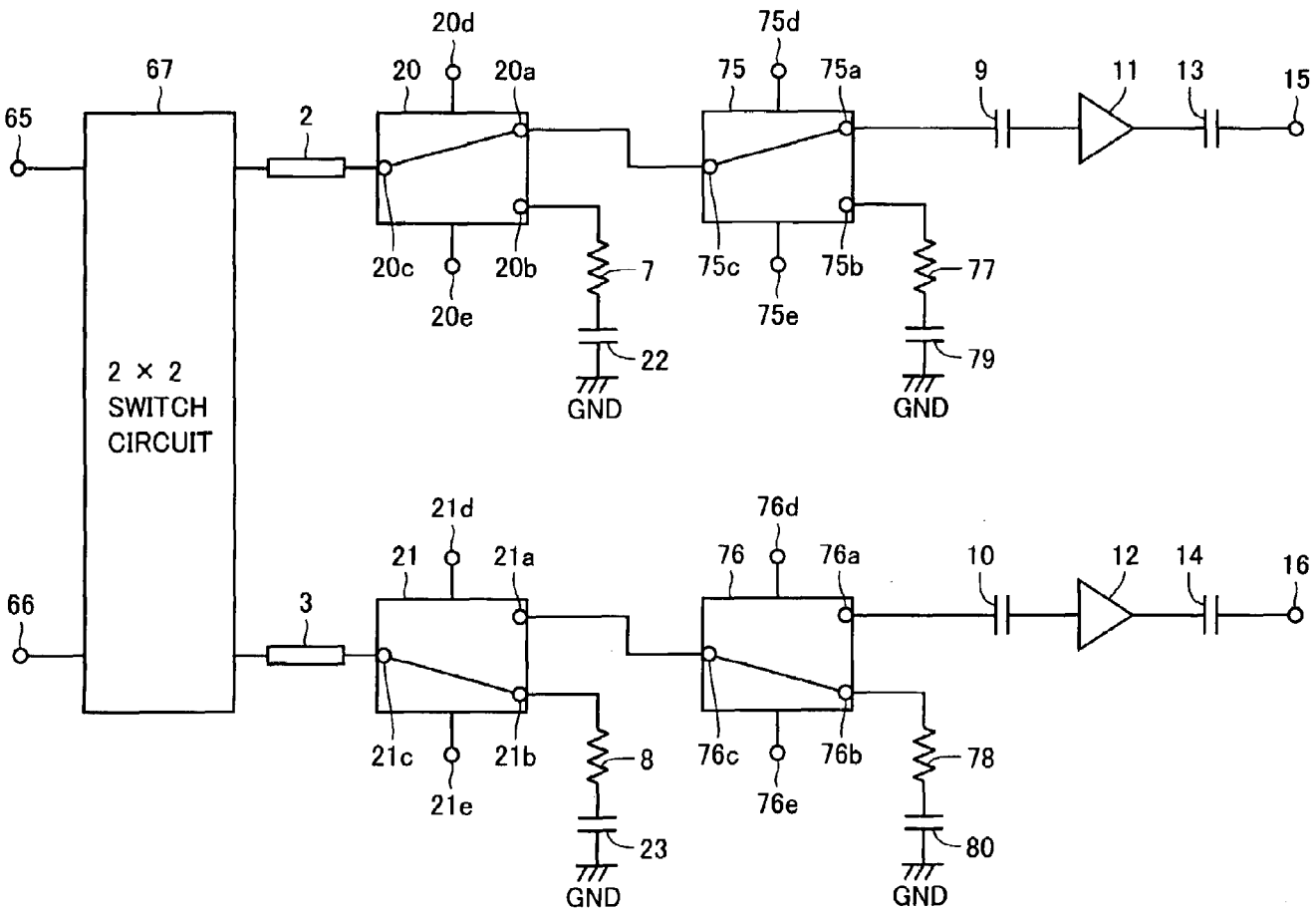
FIG. 16 is a circuit diagram showing an exemplary variation of the seventh embodiment.

FIG. 16 is a circuit diagram showing an exemplary variation of the seventh embodiment in comparison with FIG. 9. The high-frequency distribution circuit of FIG. 16 differs from that of FIG. 9 in that SPDTs 75 and 76, terminator resistors 77 and 78, and capacitors 79 and 80 are additionally introduced.

SPDT 75 includes a common terminal 75*c*, first and second conduction terminals 75*a* and 75*b*, and first and second control terminals 75*d* and 75*e*. Common terminal 75*c* is connected to SPDT 20 at the first conduction terminal 20*a*. The first conduction terminal 75*a* is connected via capacitor 9 to an input node of amplifier 11. The second conduction terminal 75*b* is connected via terminator resistor 77 and a capacitor 79 to a ground potential GND line.

The first and second control terminals 75*d* and 75*e* of SPDT 75 receive a signal having the same level as the first and second control terminals 20*d* and 20*e* of SPDT 20. SPDTs 20 and 75 are similarly switched. If SPDT 20 conducts via terminals 20*a* and 20*c*, SPDT 75 conducts via terminals 75*a* and 75*c*. If SPDT 20 conducts via terminals 20*b* and 20*c*, SPDT 75 conducts via terminals 75*b* and 75*c*.

SPDT 76 includes a common terminal 76*c*, first and second conduction terminals 76*a* and 76*b*, and first and second control terminals 76*d* and 76*e*. Common terminal 76*c* is connected to SPDT 21 at the first conduction terminal 21*a*. The first conduction terminal 76*a* is connected via capacitor 10 to an input node of amplifier 12. The second conduction terminal 76*b* is connected via terminator resistor 78 and a capacitor 80 to a ground potential GND line.

The first and second control terminals 76*d* and 76*e* of SPDT 76 receive a signal having the same level as the first and second control terminals 21*d* and 21*e* of SPDT 21. SPDTs 21 and 76 are similarly switched. If SPDT 21 conducts via terminals 21*a* and 21*c*, SPDT 76 conducts via terminals 76*a* and 76*c*. If SPDT 21 conducts via terminals 21*b* and 21*c*, SPDT 76 conducts via terminals 76*b* and 76*c*.

This exemplary variation also has the same effect as the seventh embodiment.

Figure 10:
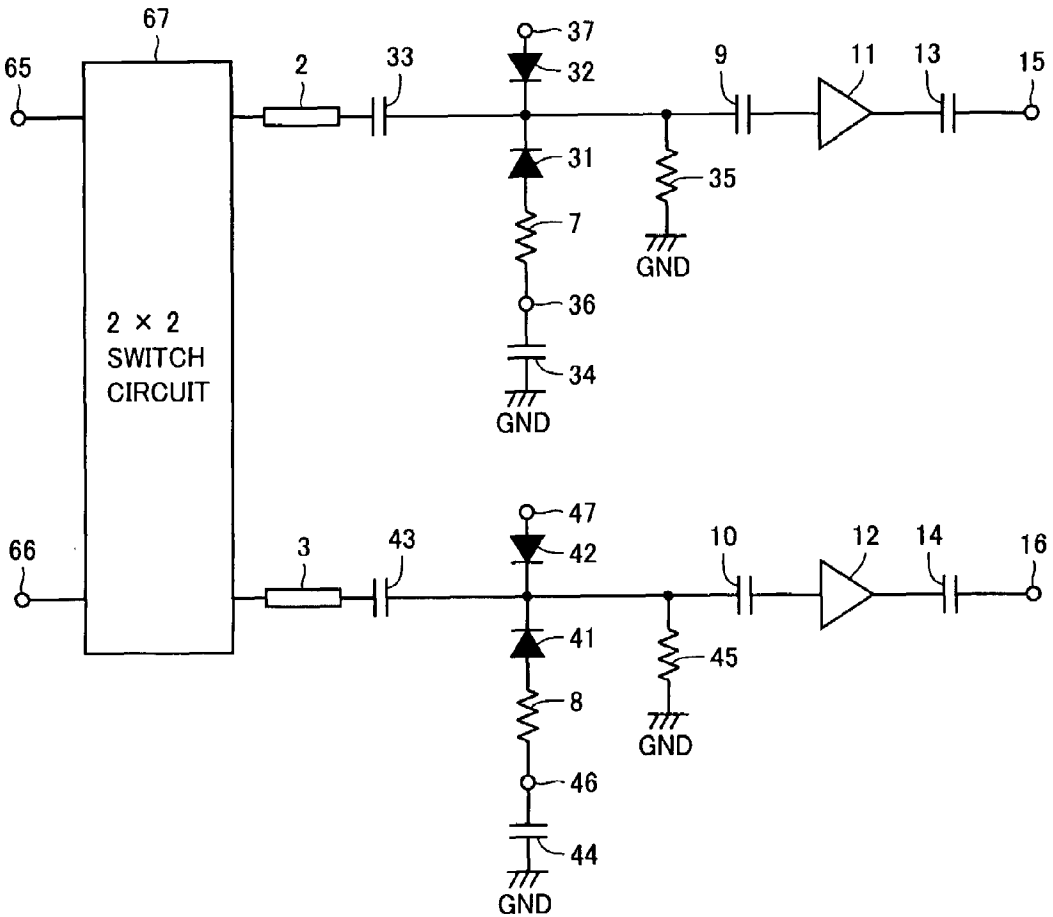
FIG. 10 is a circuit diagram showing another exemplary variation of the sixth embodiment.
Figure 17:
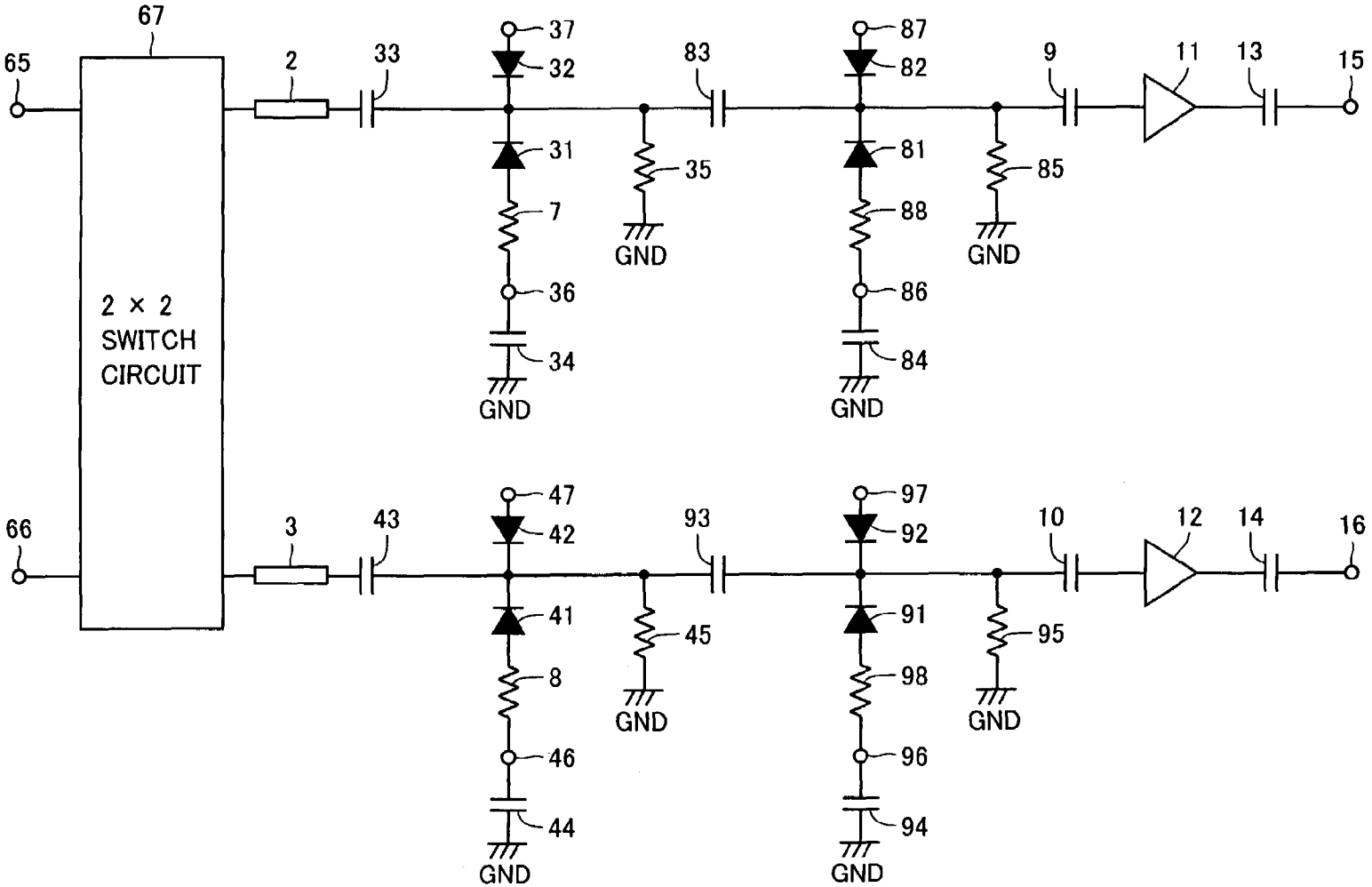
FIG. 17 is a circuit diagram showing another exemplary variation of the seventh embodiment.

FIG. 17 is a circuit diagram showing another exemplary variation of the seventh embodiment in comparison with FIG. 10. The high-frequency distribution circuit of FIG. 17 differs from that of FIG. 10 in that PIN diodes 81, 82, 91, 92, capacitors 83, 84, 93, 94, resistors 85, 88, 95, 98, first control terminals 86, 96, and second terminals 87, 97 are additionally introduced.

Capacitor 83 is connected between one terminal of resistor 35 and capacitor 9. Diode 81 has an anode connected to one terminal of terminator resistor 88 and has a cathode connected to a node located between capacitors 88 and 9. Diode 81 has resistance set to have a sufficiently small value when it conducts. Terminator resistor 88 has the other terminal connected via the first control terminal 86 and capacitor 84 to a ground potential GND line. Capacitor 84 is provided to prevent a dc current from flowing from first control terminal 86 to the ground potential GND line and has a sufficiently low impedance for a high-frequency signal. Diode 82 has an anode connected to the second terminal 87 and a cathode connected to that of diode 81. Diode 82 has resistance set to have a sufficiently large value when it conducts. Resistor 85 has a value in resistance sufficiently larger than terminator resistor 88 and is connected between the cathodes of diodes 81 and 82 and the ground potential GND line.

The first and second control terminals 86 and 87 receive the same voltages as the first and second control terminals 36 and 37, respectively. If diode 32 conducts and diode 31 does not conduct, diode 82 conducts and diode 81 does not conduct. If diode 32 does not conduct and diode 31 conducts, diode 82 does not conduct and diode 81 conducts.

Capacitor 93 is connected between one terminal of resistor 45 and capacitor 10. Diode 91 has an anode connected to one terminal of terminator resistor 98 and has a cathode connected to a node located between capacitors 93 and 10. Diode 91 has resistance set to have a sufficiently small value when it conducts. Terminator resistor 98 has the other terminal connected via the first control terminal 96 and capacitor 94 to a ground potential GND line. Capacitor 94 is provided to prevent a dc current from flowing from first control terminal 96 to the ground potential GND line and has a sufficiently low impedance for a high-frequency signal. Diode 92 has an anode connected to the second terminal 97 and a cathode connected to that of diode 91. Diode 92 has resistance set to have a sufficiently large value when it conducts. Resistor 95 has a value in resistance sufficiently larger than terminator resistor 98 and is connected between the cathodes of diodes 91 and 92 and the ground potential GND line.

The first and second control terminals 96 and 97 receive the same voltages as the first and second control terminals 46 and 47, respectively. If diode 42 conducts and diode 41 does not conduct, diode 92 conducts and diode 91 does not conduct. If diode 42 does not conduct and diode 41 conducts, diode 92 does not conduct and diode 91 conducts.

This exemplary variation also has the same effect as the seventh embodiment.

Figure 11:
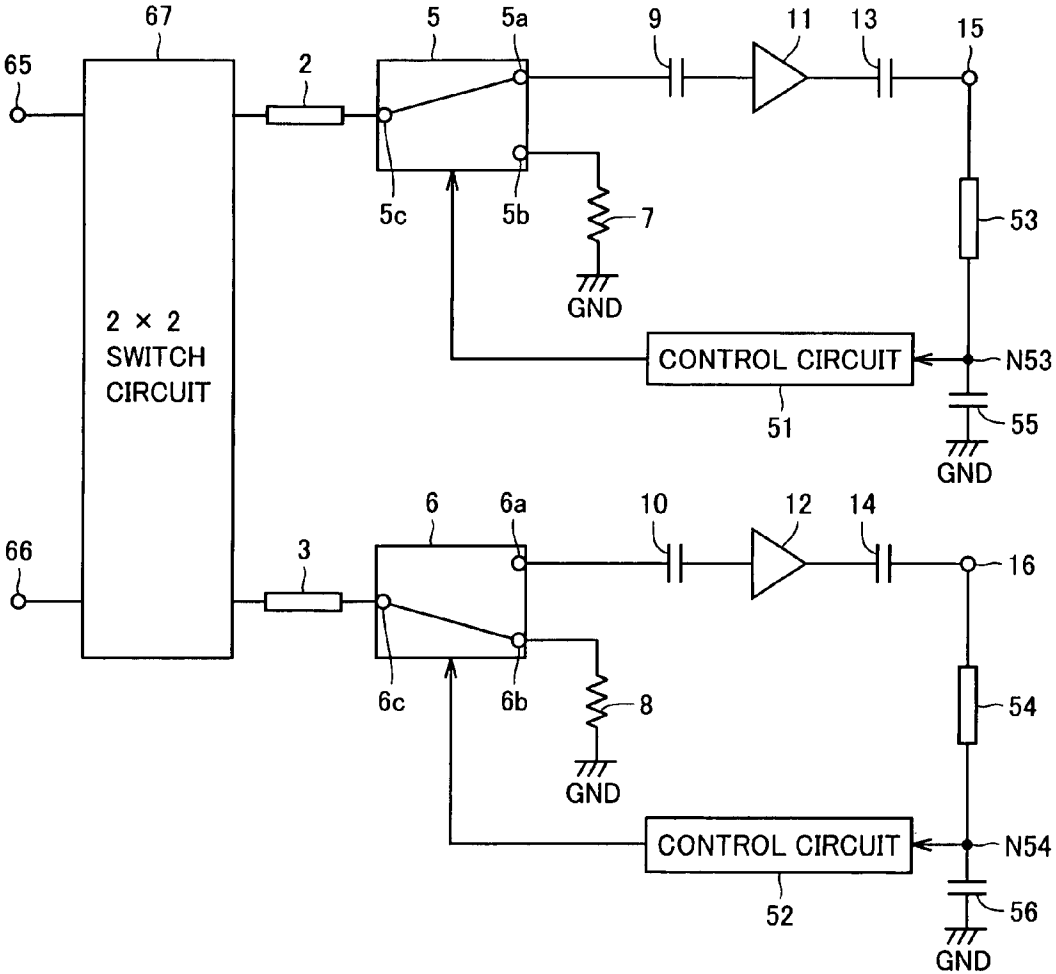
FIGS. 11-14 are circuit diagrams showing still other exemplary variations of the sixth embodiment.
Figure 12:
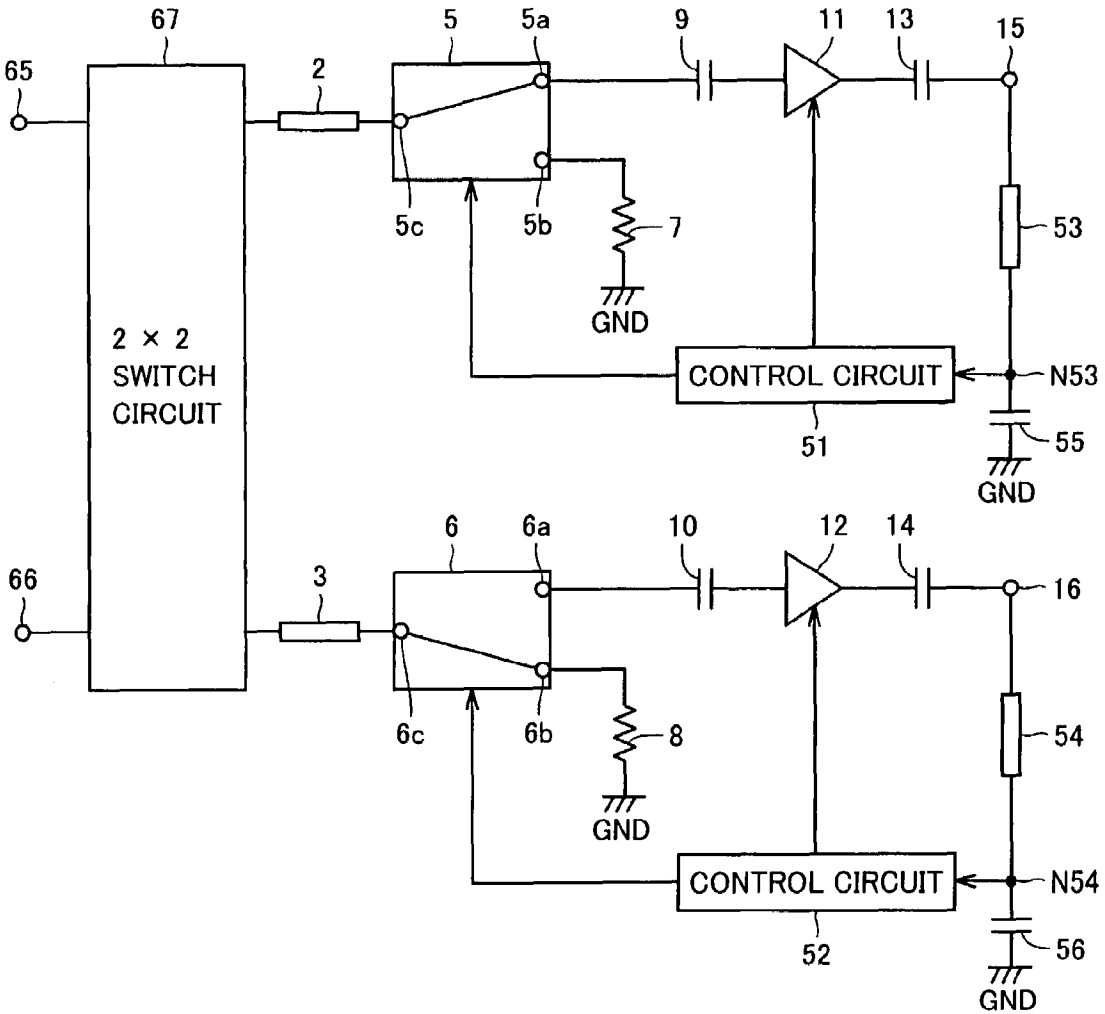
Figure 13:
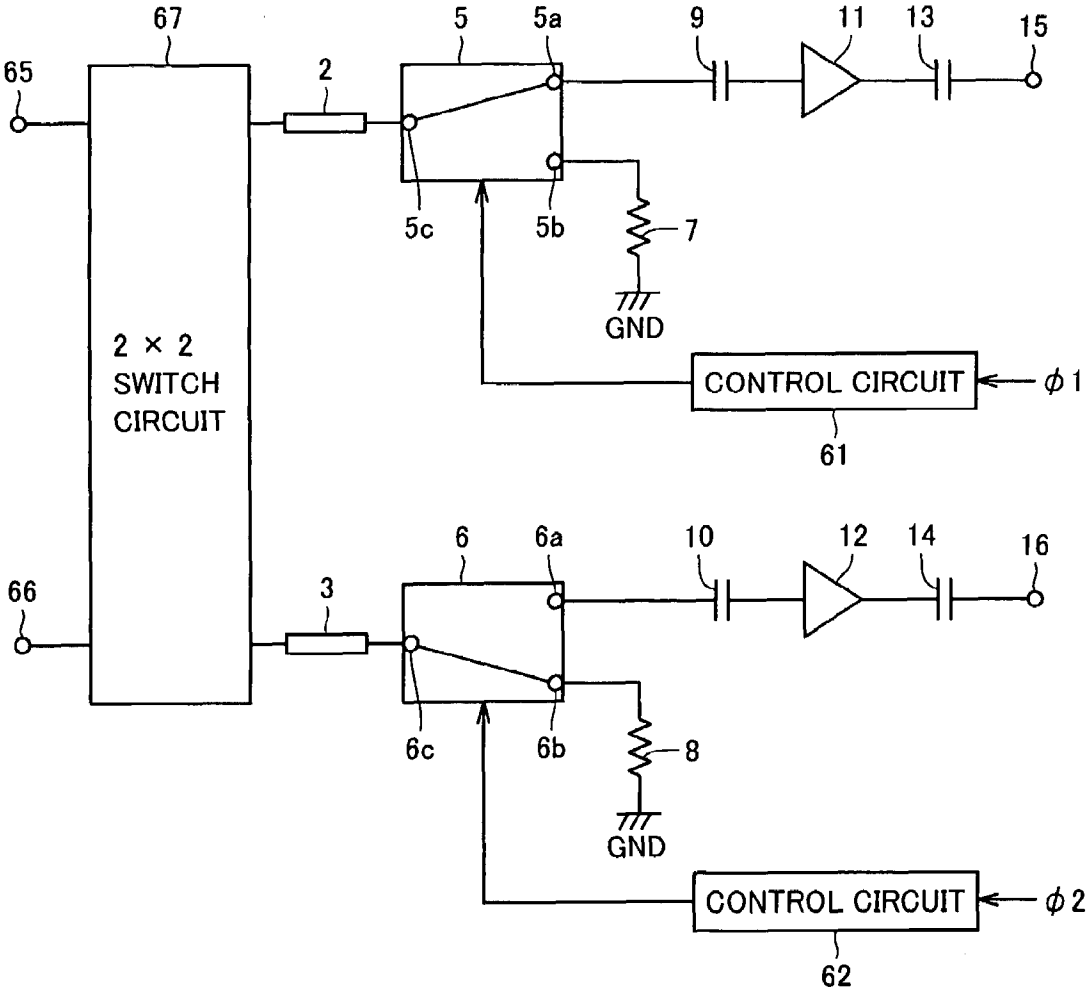
Figure 14:
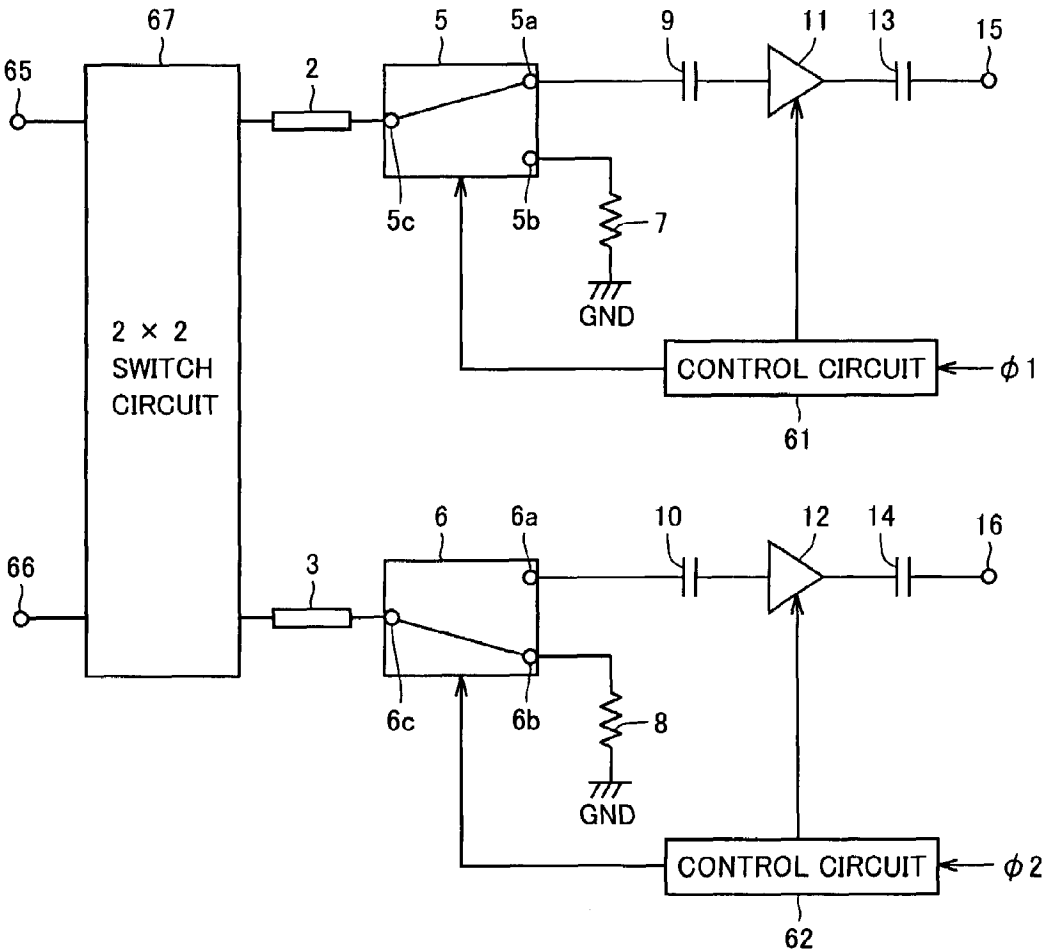
Figure 18:
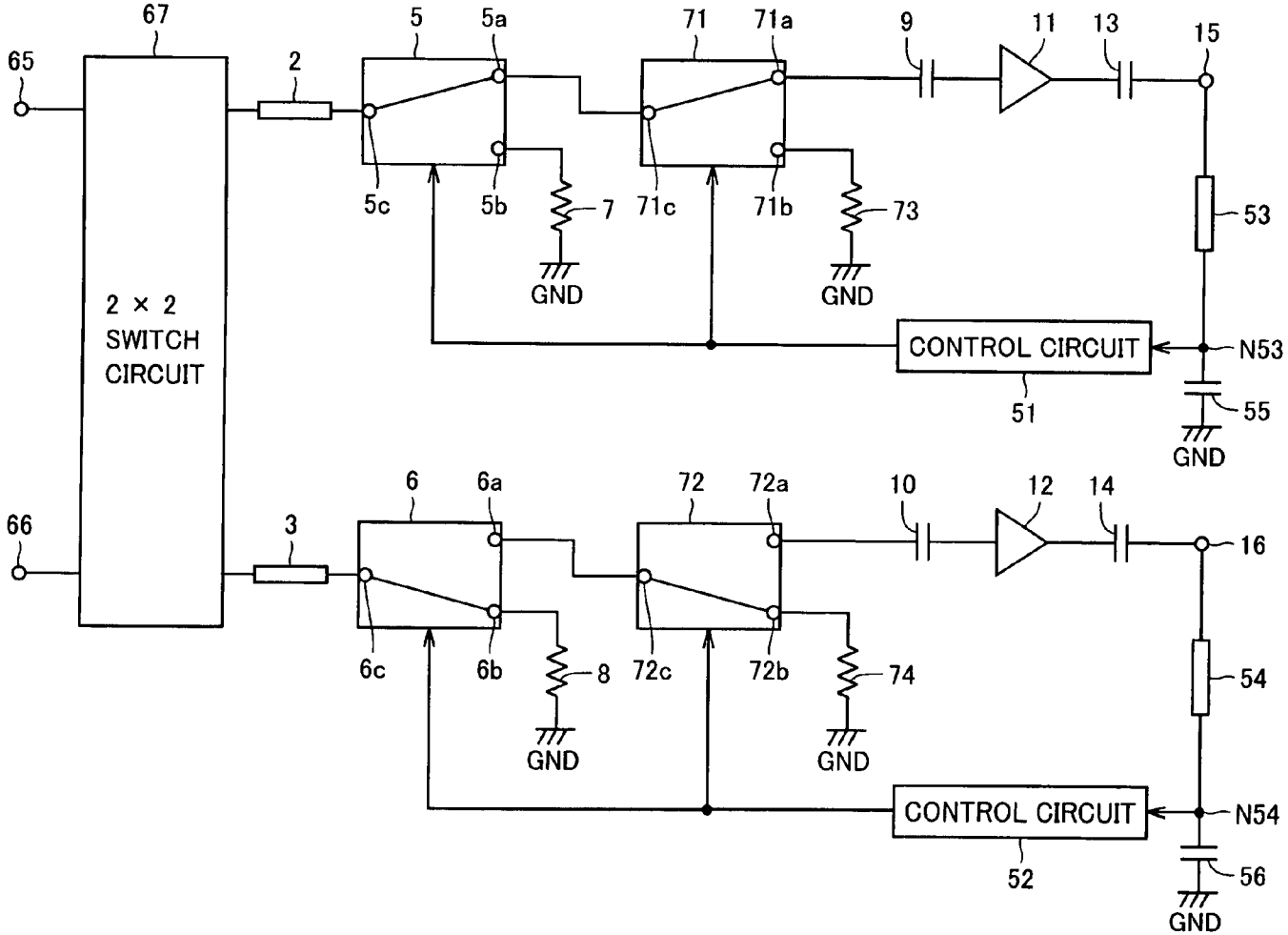
FIG. 18 is a circuit diagram showing still another exemplary variation of the seventh embodiment.
Figure 19:
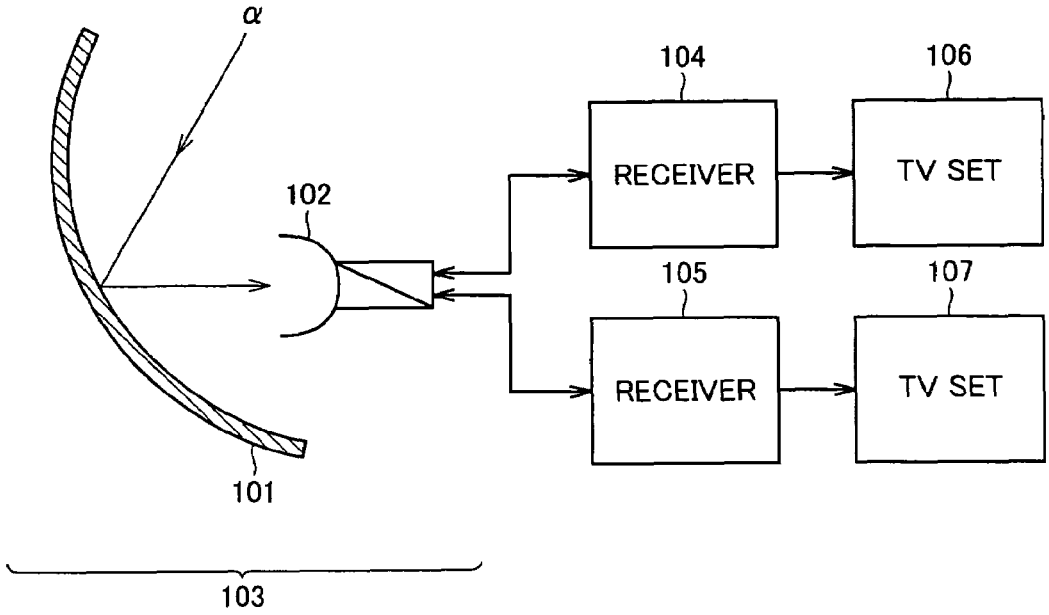
FIG.19 PRIOR ART
FIG. 19 is a block diagram showing a configuration of a receiving unit of a satellite broadcast system as conventional.

FIG. 18 is a circuit diagram showing a still another exemplary variation of the seventh embodiment in comparison with FIG. 11. The high-frequency distribution circuit of FIG. 18 differs from that of FIG. 11 in that switch circuits 71 and 72 and terminator resistors 73 and 74 are additional introduced. Switch circuits 71 and 72 and terminator resistors 73 and 74 are connected and operate, as has been described with reference to FIG. 15.

This exemplary variation also has the same effect as the seventh embodiment.

Note that the above described high-frequency distribution circuit may be configured as an integrated circuit having a transistor, a diode, a resistor, a capacitor and the like provided on a single semiconductor substrate, or may be a discrete circuit having an individual component arranged on a printed circuit board and connected.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high-frequency distribution circuit distributing to a plurality of output terminals a high-frequency signal received at an input terminal, comprising:

a plurality of high-frequency lines associated with said plurality of output terminals, respectively, and each having one end connected to said input terminal;

a terminator resistor associated with each high-frequency line;

a switch circuit associated with each high-frequency line, and passing a high-frequency signal from the other end of an associated high-frequency line to an associated output terminal if a load circuit is connected to the associated output terminal, and grounding the other end of the associated high-frequency line via an associated terminator resistor if said load circuit is not connected to the associated output terminal;

a subordinate terminator resistor associated with each switch circuit; and a subordinate switch circuit associated with each switch circuit and disposed between an associated switch circuit and an associated output terminal, and passing a high-frequency signal having passed through the associated switch circuit to the associated output terminal if said load circuit is connected to the associated output terminal, and guiding a high-frequency signal, which has leaked from the associated switch circuit, via an associated subordinate terminator resistor to a line of ground potential if said load circuit is disconnected from the associated output terminal.

2. The high-frequency distribution circuit according to claim 1, further comprising a control circuit associated with each output terminal, and outputting a first signal if a load circuit is connected to an associated output terminal, and outputting a second signal if the load circuit is not connected to the associated output terminal, wherein said switch circuit passes a high-frequency signal from the other end of the associated high-frequency line to the associated output terminal if an associated control circuit outputs said first signal, and said switch circuit grounds the other end of the associated high-frequency line via the associated terminator resistor if the associated control circuit outputs said second signal.

3. The high-frequency distribution circuit according to claim 2, wherein:

said load circuit applies a power supply voltage to said output terminal in response to said load circuit being connected to said output terminal; and said control circuit outputs said first signal if said power supply voltage is applied to the associated output terminal, and said control circuit outputs said second signal if said power supply voltage is not applied to the associated output terminal.

4. The high-frequency distribution circuit according to claim 2, wherein:

said switch circuit includes a SPDT including a common terminal connected to the other end of the associated high-frequency line, a first conduction terminal connected to the associated output terminal, a second conduction terminal connected to one end of the terminator resistor, and a control terminal, and if a first voltage is applied to said control terminal, said common terminal and said first conduction terminal are electrically connected, and if a second voltage is applied to said control terminal, said common terminal and said second conduction terminal are electrically connected;

said terminator resistor has the other terminal grounded; and said first signal is said first voltage applied to said first control terminal and said second signal is said second voltage applied to said control terminal.

5. The high-frequency distribution circuit according to claim 4, wherein said subordinate terminator resistors are, respectively, associated with each SPDT, said subordinate switch circuits include a subordinate SPDT associated with each SPDT, each subordinate SPDT including a subordinate common terminal connected to a first conduction terminal of an associated SPDT, a first subordinate conduction terminal connected to an associated output terminal, a second subordinate conduction terminal connected to one terminal of an associated subordinate terminator resistor, and a subordinate control terminal, said subordinate SPDT having said subordinate common terminal and said first subordinate conduction terminal electrically connected when said first voltage is applied to said subordinate control terminal, said subordinate SPDT having said subordinate common terminal and said second subordinate conduction terminal electrically connected when said second voltage is applied to said subordinate control terminal, said subordinate terminator resistor has the other terminal grounded, and equal voltage is applied to said subordinate control terminal of said subordinate SPDT and said control terminal of the associated SPDT.

6. The high-frequency distribution circuit according to claim 2, wherein said switch circuit includes a switching element connected in series to an associated terminator resistor between the other end of an associated high-frequency line and a line of a ground potential, and not conducting if said control circuit outputs said first signal and conducting if said control circuit outputs said second signal.

7. The high-frequency distribution circuit according to claim 6, wherein said subordinate terminator resistors are, respectively, associated with each switching element, and said subordinate switch circuit includes a subordinate switching element connected in series to an associated subordinate terminator resistor between the other end of an associated high-frequency line and a line of ground potential, and not conducting if said control circuit outputs said first signal and conducting if said control circuit outputs said second signal.

8. The high-frequency distribution circuit according to claim 2, further comprising an amplifier associated with each high-frequency line, and receiving a high-frequency signal from the other end of an associated high-frequency line to amplify said high-frequency signal and provides an associated output terminal with said high-frequency signal amplified, wherein said control circuit activates an associated amplifier if said load circuit is connected to the associated output terminal, and said control circuit inactivates said amplifier if said load circuit is disconnected from the associated output terminal.

9. The high-frequency distribution circuit according to claim 1, configured as a discrete circuit.

10. The high-frequency distribution circuit according to claim 1, configured as an integrated circuit.

11. A high-frequency distribution circuit having a plurality of input terminals and a plurality of output terminals, and selecting a high-frequency signal of a plurality of high-frequency signals, which are provided to said plurality of input terminals, for each output terminal to provide the selected high-frequency signal to said output terminal, comprising:

a plurality of high-frequency lines associated with said plurality of output terminals, respectively;

a select circuit selecting a high-frequency signal of a plurality of high-frequency signals, which are provided to said plurality of input terminals, for each high-frequency line to provide the selected high-frequency signal to one end of said high-frequency line;

a terminator resistor associated with each high-frequency line;

a switch circuit associated with each high-frequency line, and passing a high-frequency signal from the other end of an associated high-frequency line to an associated output terminal if a load circuit is connected to the associated output terminal, and grounding the other end of the associated high-frequency line via an associated terminator resistor if said load circuit is not connected to the associated output terminal; and a subordinate terminator resistor associated with each switch circuit; and a subordinate switch circuit associated with each switch circuit and disposed between an associated switch circuit and an associated output terminal, and passing a high-frequency signal having passed through the associated switch circuit to the associated output terminal if said load circuit is connected to the associated output terminal, and guiding a high-frequency signal, which has leaked from the associated switch circuit, via an associated subordinate terminator resistor to a line of ground potential if said load circuit is disconnected from the associated output terminal.

12. The high-frequency distribution circuit according to claim 11, further comprising a control circuit associated with each output terminal, and outputting a first signal if a load circuit is connected to an associated output terminal, and outputting a second signal if the load circuit is not connected to the associated output terminal, wherein said switch circuit passes a high-frequency signal from the other end of the associated high-frequency line to the associated output terminal if an associated control circuit outputs said first signal, and said switch circuit grounds the other end of the associated high-frequency line via the associated terminator resistor if the associated control circuit outputs said second signal.

13. The high-frequency distribution circuit according to claim 12, wherein:

said load circuit applies a power supply voltage to said output terminal in response to said load circuit being connected to said output terminal; and said control circuit outputs said first signal if said power supply voltage is applied to the associated output terminal, and said control circuit outputs said second signal if said power supply voltage is not applied to the associated output terminal.

14. The high-frequency distribution circuit according to claim 12, wherein:

said switch circuit includes a SPDT including a common terminal connected to the other end of the associated high-frequency line, a first conduction terminal connected to the associated output terminal, a second conduction terminal connected to one end of the terminator resistor, and a control terminal, and if a first voltage is applied to said control terminal, said common terminal and said first conduction terminal are electrically connected, and if a second voltage is applied to said control terminal, said common terminal and said second conduction terminal are electrically connected;

said terminator resistor has the other terminal grounded; and said first signal is said first voltage applied to said first control terminal and said second signal is said second voltage applied to said control terminal.

15. The high-frequency distribution circuit according to claim 14, wherein said subordinate terminator resistors are, respectively, associated with each SPDT, said subordinate switch circuits include a subordinate SPDT associated with each SPDT, each subordinate SPDT including a subordinate common terminal connected to a first conduction terminal of an associated SPDT, a first subordinate conduction terminal connected to an associated output terminal, a second subordinate conduction terminal connected to one terminal of an associated subordinate terminator resistor, and a subordinate control terminal, said subordinate SPDT having said subordinate common terminal and said first subordinate conduction terminal electrically connected when said first voltage is applied to said subordinate control terminal, said subordinate SPDT having said subordinate common terminal and said second subordinate conduction terminal electrically connected when said second voltage is applied to said subordinate control terminal, said subordinate terminator resistor has the other terminal grounded, and equal voltage is applied to said subordinate control terminal of said subordinate SPDT and said control terminal of the associated SPDT.

16. The high-frequency distribution circuit according to claim 12, wherein said switch circuit includes a switching element connected in series to an associated terminator resistor between the other end of an associated high-frequency line and a line of a ground potential, and not conducting if said control circuit outputs said first signal and conducting if said control circuit outputs said second signal.

17. The high-frequency distribution circuit according to claim 16, wherein said subordinate terminator resistors are, respectively associated with each switching element, and said subordinate switch circuit includes a subordinate switching element connected in series to an associated subordinate terminator resistor between the other end of an associated high-frequency line and a line of ground potential, and not conducting if said control circuit outputs said first signal and conducting if said control circuit outputs said second signal.

18. The high-frequency distribution circuit according to claim 12, further comprising an amplifier associated with each high-frequency line, and receiving a high-frequency signal from the other end of an associated high-frequency line to amplify said high-frequency signal and provides an associated output terminal with said high-frequency signal amplified, wherein said control circuit activates an associated amplifier if said load circuit is connected to the associated output terminal, and said control circuit inactivates said amplifier if said load circuit is disconnected from the associated output terminal.

19. The high-frequency distribution circuit according to claim 11, configured as a discrete circuit.

20. The high-frequency distribution circuit according to claim 11, configured as an integrated circuit.

* * * * *